US011700899B1

(12) United States Patent
Goldstone

(10) Patent No.: US 11,700,899 B1
(45) Date of Patent: Jul. 18, 2023

(54) AI-BASED SYSTEM INCLUDING DRESS FORM CREATION

(71) Applicant: Pari Passu New York, LLC, New York, NY (US)

(72) Inventor: Shanna Goldstone, New York, NY (US)

(73) Assignee: Pari Passu New York, LLC, New York, NY (US)

( * ) Notice: Subject to any disclaimer, the term of this patent is extended or adjusted under 35 U.S.C. 154(b) by 0 days.

(21) Appl. No.: 17/886,686

(22) Filed: Aug. 12, 2022

(51) Int. Cl.
*A41H 3/00* (2006.01)
*A41H 1/02* (2006.01)

(52) U.S. Cl.
CPC ..... *A41H 3/007* (2013.01); *A41H 1/02* (2013.01)

(58) Field of Classification Search
CPC ..... A41H 3/007; A41H 1/02
USPC ..... 700/132
See application file for complete search history.

(56) References Cited

U.S. PATENT DOCUMENTS 6,546,309 B1 * 4/2003 Gazzuolo ..... G06T 17/20 702/167
7,092,782 B2 * 8/2006 Lee ..... G06Q 30/02 700/132
7,548,794 B2 * 6/2009 Vandergrift ..... G06Q 30/0601 700/132
2004/0078285 A1 * 4/2004 Bijvoet ..... A41H 1/00 702/167

OTHER PUBLICATIONS

"Parri Passu Shop Post," Apr. 15, 2019.

* cited by examiner

*Primary Examiner* — Nathan E Durham
(74) *Attorney, Agent, or Firm* — Weiss & Arons LLP

(57) ABSTRACT

An artificially-intelligent body size and body shape identification system is provided. The system may include a graphical user interface ("GUI"). The GUI may display a plurality of body shapes. The GUI may also receive a selection of one of a plurality of body shapes. The selection may indicate that a body corresponds to the selected body shape. The GUI may receive measurement information including: a height measurement, a weight measurement, a bra cup size, a bra length size relating to the body. The system may include an artificially-intelligent, sizing application. The application may receive the measurement information and the selected body shape. The application may identify one or more combinations of one or more body shapes and one or more body sizes that correspond to the body. The GUI may display the one or more combinations. The GUI may receive a selection of one of the combinations.

18 Claims, 22 Drawing Sheets

AI-BASED SYSTEM INCLUDING DRESS FORM CREATION

FIELD OF TECHNOLOGY

Aspects of the disclosure relate to fit systems.

BACKGROUND OF THE DISCLOSURE

The fashion industry uses traditional dress forms when designing clothing. The traditional dress forms correspond to traditional dress sizes. Conventionally, a garment was sized up or down by adding inches to the various portions of a sample size garment. Traditional garment sizing—i.e., adding or subtracting inches to a sample size garment—may be effective within a predetermined size range. However, when a small sample size is graded up substantially, after a certain amount of proportional grading up or grading down, the garment may lose its design integrity and not fit properly.

As such, it would be desirable to create dress forms for various size ranges. It would be further desirable for each of the dress forms to correlate with body shapes. It would be further desirable for the body shapes to be derived from actual three-dimensional body scans. It would be further desirable to create dress forms that correlate with multiple body shapes in addition to multiple body sizes.

SUMMARY OF THE DISCLOSURE

Apparatus and methods for an artificially-intelligent body size and body shape identification system is provided. The system may include a graphical user interface ("GUI"). The GUI may operate on a hardware processor. The hardware processor may be coupled to a hardware memory.

The GUI may be operable display a plurality of body shapes. The body shapes may include a first body shape, a second body shape, a third body shape and any other suitable body shapes. The GUI may also include a brief description of each of the body shapes.

The GUI may receive a selection of one of the body shapes included in the plurality of body shapes. The GUI may receive a height measurement, weight measurement, bra cup size, bra length size, the age and/or any other suitable information relating to a body.

The system may include an artificially-intelligent, sizing application. The application may operate on the hardware processor coupled to the memory. The application may receive the height measurement, the weight measurement, the age, the bra cup size and the bra length size and the body shape selection.

The application may select one or more combinations of one or more body shapes and one or more body size that correspond to the body. The selection of the application may be based on the received height measurement, weight measurement, age, bra cup size, bra length size and body shape selection.

At certain embodiments, the application may identify that that selection of the body shape does not correspond to the height measurement, weight measurement, the age, the bra cup size, the bra length size or any other received measurement information. Therefore, the application may select one or more applicable combinations of one or more body shapes and one or more body sizes. The one or more applicable combinations may be based on the height measurement, the weight measurement, the age, the bra cup size, the bra length size and any other suitable information. The application may also recommend, using the GUI, selection of a different body shape from the previously selected body shape. The GUI may present the opportunity for a user to select the different body shape.

The GUI may present or display one or more combinations of the one of body shapes and the one or more body sizes. The GUI may receive the one or more combinations from the application.

After presentation of the of the one or more combinations on the GUI, the GUI may request and/or receive a first body measurement and a second body measurement. The first body measurement may be a circumference around the body. The circumference being measured at a crease in a torso of the body when the body is bent to one side.

The second body measurement may also be a circumference around the body. The circumference may be around a widest point on the body below the crease in the torso.

The artificially-intelligent, sizing application may receive the first body measurement and the second body measurement. The application may process a differential between the first body measurement and the second body measurement. The application may re-select, based on the differential, the one or more combinations of one or more body shapes and one or more body sizes that correspond to the body. The application may forward the one or more combinations to the one or more body shapes and the one or more body sizes that correspond to the body.

The first body shape may include a differential between the first body measurement and the second body measurement of between about −2.0 and 3.0 inches. The second body shape may include a differential between the first body measurement and the second body measurement of between about 3.1 inches and 8.0 inches. The third body shape may include a differential of approximately greater than 8.0 inches.

The GUI may receive a selection of one of the more combinations of body shapes and body sizes. The GUI may use the selection of the one of the one or more applicable combinations of body shapes and body sizes to facilitate a purchase of one or more articles of clothing.

The application may receive data relating to a return of the purchase of the one or more articles of clothing. The application may compare a set of measurements of the one or more articles of clothing to the height measurement, the weight measurement, the age, the bra cup size, the bra length size and the selection of one of the body shapes. The application may identify one or more locations in the set of measurements in which the one or more articles of clothing was unsuitable. The application may import the one or more locations that were unsuitable to a database. The database may power the artificially-intelligent, sizing application. The importing the one or more locations that were unsuitable may augment a set of training data included in the database. The one or more locations may increase a knowledge base of the one or more body sizes and the one or more body shapes.

BRIEF DESCRIPTION OF THE DRAWINGS

The objects and advantages of the invention will be apparent upon consideration of the following detailed description, taken in conjunction with the accompanying drawings, in which like reference characters refer to like parts throughout, and in which.

DETAILED DESCRIPTION OF THE DISCLOSURE

Figure 1:
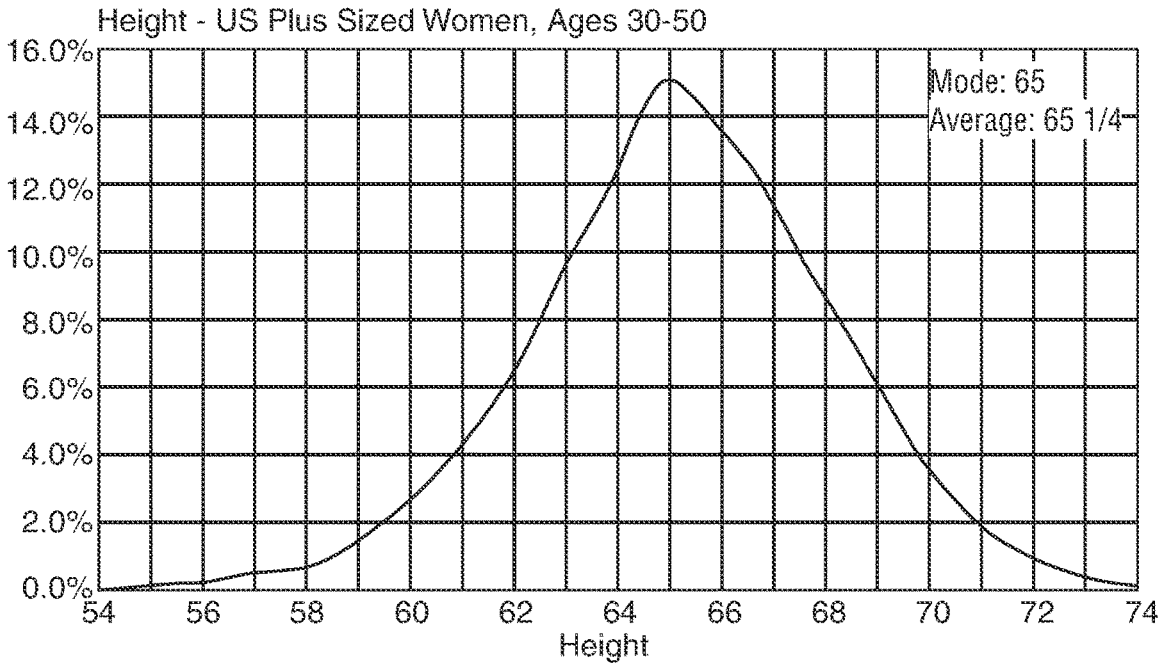
FIG. 1 shows an illustrative graph in accordance with principles of the disclosure.

Apparatus and methods for an AI-based fit system including dress form creation is provided.

One or more non-transitory computer-readable media storing computer-executable instructions which, when executed by a processor on a computer system is provided. The method may identify one or more body sizes and one or more body shapes in response to received body measurement information. The body measurement information may relate to a body.

The method may include receiving body measurement information. The body measurement information may relate to a body. The body measurement information may be received at an artificially-intelligent, sizing application. The body measurement information may include a height measurement, a weight measurement, a bra cup size, a bra length size and/or an age.

It should be noted that, at times, a portion of body measurement may be used to determine a body's size and shape. However, all of the body measurement information may be collected in order to retrieve data relating to a purchase of clothing. As such, age may or may not be used to identify a body shape. However, age may be used to recommend articles of clothing or another suitable purpose.

The method may also include receiving a selection of a body shape from a plurality of body shapes. The plurality of body shapes may be stored at a database. The selection of the body shape may be received at the artificially-intelligent, sizing application. The selection of the body shape may be also referred to as a user-selection body shape.

The method may also include approximating a waist measurement and a low hip measurement based on the body measurement information. The approximating may be executed at the artificially-intelligent, sizing application. The waist measurement may be a crease in the body when the body is bent to one side. The low hip measurement may be a widest point on the body below the waist measurement.

The method may include processing a differential between the waist measurement and the low hip measurement. The processing may be executed by the artificially-intelligent, sizing application. The differential between the waist measurement and the low hip measurement may be used to identify a body shape of a body. The differential may be calculated by subtracting the waist measurement from the low hip measurement (low hip measurement minus waist measurement equals differential).

The method may include selecting one or more body shapes that correspond to the body. The selecting may be executed by the artificially-intelligent, sizing application. The selecting may be based on the differential and/or based on the user-selected body shape. The selecting may select one or more body shapes from the plurality of body shapes.

At times, the application may not calculate an approximated waist measurement and an approximated low hip measurement. As such, the application may select the user-selected body shape as the body shape the corresponds to the user.

The method may also include selecting one or more body sizes that correspond to the body. The selecting may be executed at the artificially-intelligent, sizing application. The selecting may be based on the received body measurement information. The selecting may utilize some or all of the body measurement information to identify the appropriate body size for the body. The selecting may be from a plurality of body sizes stored at the database.

The method may also include presenting one or more combinations of the one or more body shapes and one or more body sizes. The presenting may be executed at a graphical user interface. The presenting may be powered by the artificially-intelligent, sizing application.

Each of the one or more combinations may be accompanied by a percentage of accuracy that the body corresponds to combination. A sum of the percentages of accuracy may be 100%. For example, the application may identify two body size and shape combinations for a specific body. A first body size combination may be D2 (body shape D and body size 2). A second body size combination may be C3 (body shape C and body size 3). The application may display a 67% percent accuracy symbol next to D2. The application may also display a 33% percent accuracy symbol next to C3. Accordingly, the sum of the percentages of accuracy are 100%.

The application may receive a selection of one of the one or more body size and body shape combinations. For example, a user may select D2 at the application.

At times, a user may indicate that he would like to enter a waist measurement and a low hip measurement. Such an indication may be received at the artificially-intelligent application. Such an indication may be received when a user indicates that the percentage of accuracy is not sufficiently high. As such, the application may receive a user-inputted waist measurement and a user-inputted low hip measurement.

In response to receiving the waist measurement and the low hip measurement, the application may reprocess the differential between the waist measurement and the low hip measurement. The reprocessed differential may indicate the difference between the user-inputted waist measurement and the user-inputted low hip measurement instead of the approximated waist measurement and the approximated low hip measurement.

The application may re-identify one or more body shapes based on the differential. It should be noted that, at times, the re-identification may confirm the user-selected body shape. Other times, the re-identifying may override the user-selected body shape. The application may re-identify one or more body sizes based on the received body measurement information. The application may re-present one or more combinations of the one or more body shapes and the one or more body sizes.

The application may prepopulate the selection of the one or more body size and body shape combinations into shape and size selection fields. The application may prepopulate the combination when a user selects one or more articles of clothing. The application may recommend using the selection when selecting one or more articles of clothing. The application may utilize the selection to facilitate a purchase of one or more articles of clothing.

At times, upon purchasing an article of clothing, a purchaser may be unhappy with the purchase. Therefore, the purchaser may return the article of clothing. When an article of clothing is returned, the application may receive an indication of a return of the purchase of the one or more articles of clothing. The application may compare a set of measurements of the one or more articles of clothing to the received body measurement information. The application may identify one or more locations in the set of measurements in which the one or more articles of clothing was unsuitable. The application may import the one or more locations that were unsuitable to the database. The database may power the application. The importing may increase a knowledge base on the plurality of body sizes and the plurality of body shapes.

At times, upon purchasing an article of clothing, a purchaser may be content with the purchase. The application may receive an indication of contentment of the purchase of the one or more articles of clothing. Such an indication may include failure to return the one or more articles of clothing. Such an indication may include transmitting a message stating the indication of contentment. The application may compare a set of measurements of the one or more articles of clothing to the received body measurement information. The application may identify one or more locations in the set of measurements in which the one or more articles of clothing was suitable. The application may import the one or more locations that were suitable to the database. The database may power the application. The importing may increase a knowledge base on the plurality of body sizes and the plurality of body shapes.

The one or more body shapes included in the plurality of body shapes may include a first body shape, a second body shape and a third body shape. The first body shape may have a differential between the low hip measurement and the waist measurement up to and including 3.0 inches. It should be noted that, at times, a body that fits into the first body shape may have a low hip measurement that is smaller than the waist measurement. Therefore, in such a body shape, the low hip measurement may be measured as the circumference of the body that is between approximately 7 and 11 inches below the waist measurement. At times, the differential may be less or more depending on other body measurement information. The first body shape may have over a threshold of similarity between a bust measurement, the waist measurement and the low hip measurement. The bust measurement may be determined by the bra cup size and the bra length size. The first body shape may have a greater concentration of body weight in a front central portion of a body. The first body shape may include a widest body part circumference being a waist identified by the waist measurement. The first body shape may be referred to as a straight body shape.

The second body shape may have a differential between the low hip measurement and the waist measurement between about 3.1 inches and 8.0 inches. At times, the differential may be less or more depending on other body measurement information. The second body shape may have over a threshold of similarity between a bust measurement and the low hip measurement. The bust measurement may be determined by the bra cup size and the bra length size. The second body shape may have evenly distributed body weight within a body torso. The second body shape may have a widest body part circumference being either a bust, identified by the bust measurement or hips, identified by the low measurement. The second body shape may be referred to as an average shape.

The third body shape may have a differential between the low hip measurement and the waist measurement of greater than 8.0 inches. The waist measurement may be smaller than the low hip measurement. The bust measurement may be smaller than the low hip measurement. The bust measurement may be determined by the cup size and the bra length size. The third body shape may have a greater concentration of body weight in a body thighs portion of a body backside portion. The third body shape may have a widest body part circumference being hips identified by the low hip measurement. The third body shape may be referred to as a curvy shape.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is to be understood that other embodiments may be utilized and that structural, functional and procedural modifications may be made without departing from the scope and spirit of the present disclosure.

The steps of methods may be performed in an order other than the order shown or described herein. Embodiments may omit steps shown or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The data shown in the graphs included in the figures may have been retrieved from three-dimensional body scans of a plurality of bodies.

FIG. 1 shows an illustrative graph. The illustrative graph shows the percentage of heights of plus size women. The x-axis on the graph shows the height in inches. The y-axis on the graph shows the percentage of plus size women for each height. For the purposes of this application, plus size women may be defined as women US size 14 and above.

It should be noted that the average height of a US plus size woman between the ages of 30 and 50 may be 65¼ inches. The mode height of a US plus size woman between the ages of 30 and 50 may be 65 inches.

Figure 2:
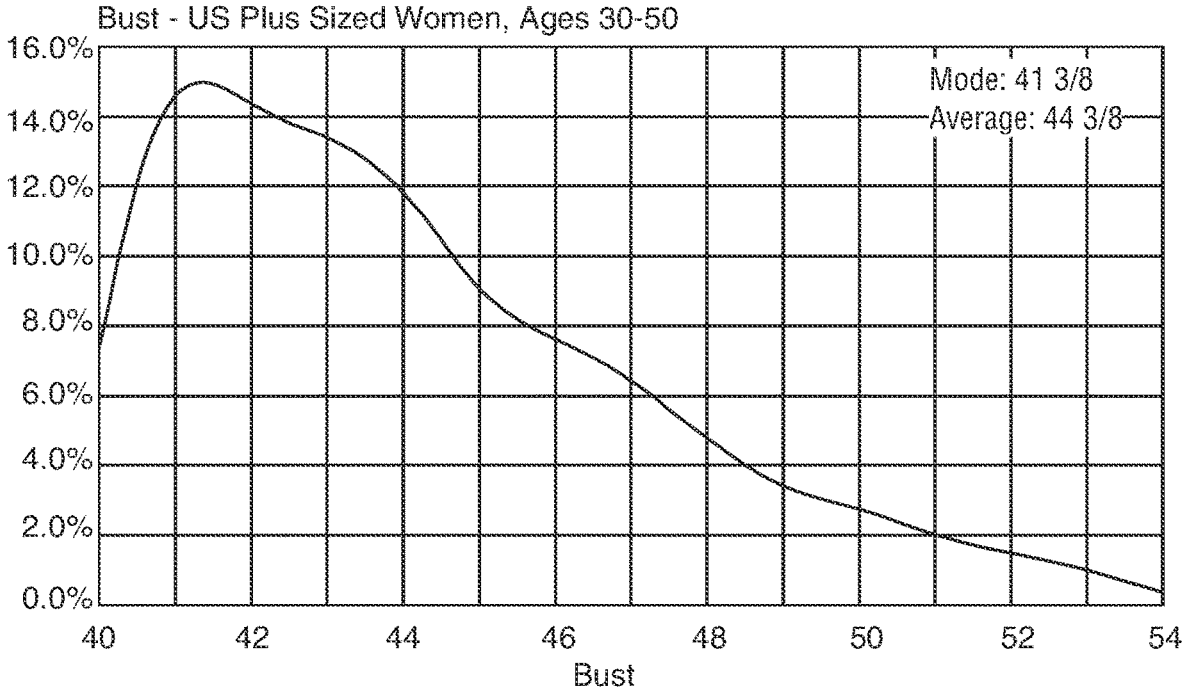
FIG. 2 shows another illustrative graph in accordance with principles of the disclosure.

FIG. 2 shows an illustrative graph. The illustrative graph shows the percentage of busts of plus size women. The x-axis on the graph shows the bust in inches. The y-axis on the graph shows the percentage of plus size women for each bust measurement.

A bust may include a complete chest measurement. As such, the bust may include both a bra length size and a bra cup size. The bra length size may be used as a base and the bra cup size may be added to the base. The number of inches added by each bra cup size may be shown in Table A below:

TABLE A

| Bust/band difference in inches | US cup size |
|---|---|
| <1 | AA |
| 1 | A |
| 2 | B |
| 3 | C |
| 4 | D |
| 5 | E or DD |
| 6 | F or DDD |
| 7 | G or DDDD |
| 8 | H |
| 9 | I |
| 10 | J |
| 11 | K |
| 12 | L |
| 13 | M |
| 14 | N |

It should be noted that the average bust of a US plus size woman between the ages of 30 and 50 may be 41⅜ inches. The mode bust of a US plus size woman between the ages of 30 and 50 may be 44⅜ inches.

Figure 3:
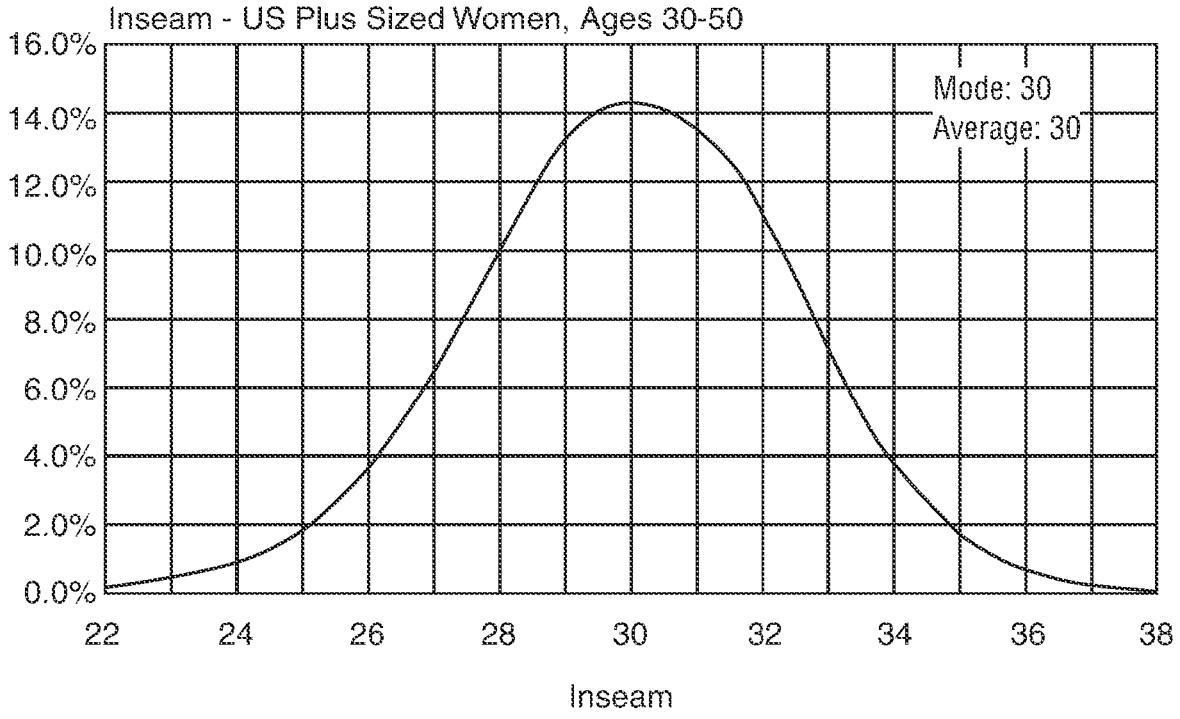
FIG. 3 shows yet another illustrative graph in accordance with principles of the disclosure.

FIG. 3 shows an illustrative graph. The illustrative graph shows the percentage of inseam measurements of plus size women. An inseam measurement is a measurement from a crotch to an ankle. The x-axis on the graph shows the inseam measurement in inches. The y-axis on the graph shows the percentage of plus size women for each inseam measurement. Both the mode and the average inseam measurement of a US plus size woman between the ages of 30 and 50 may be 30 inches.

Figure 4:
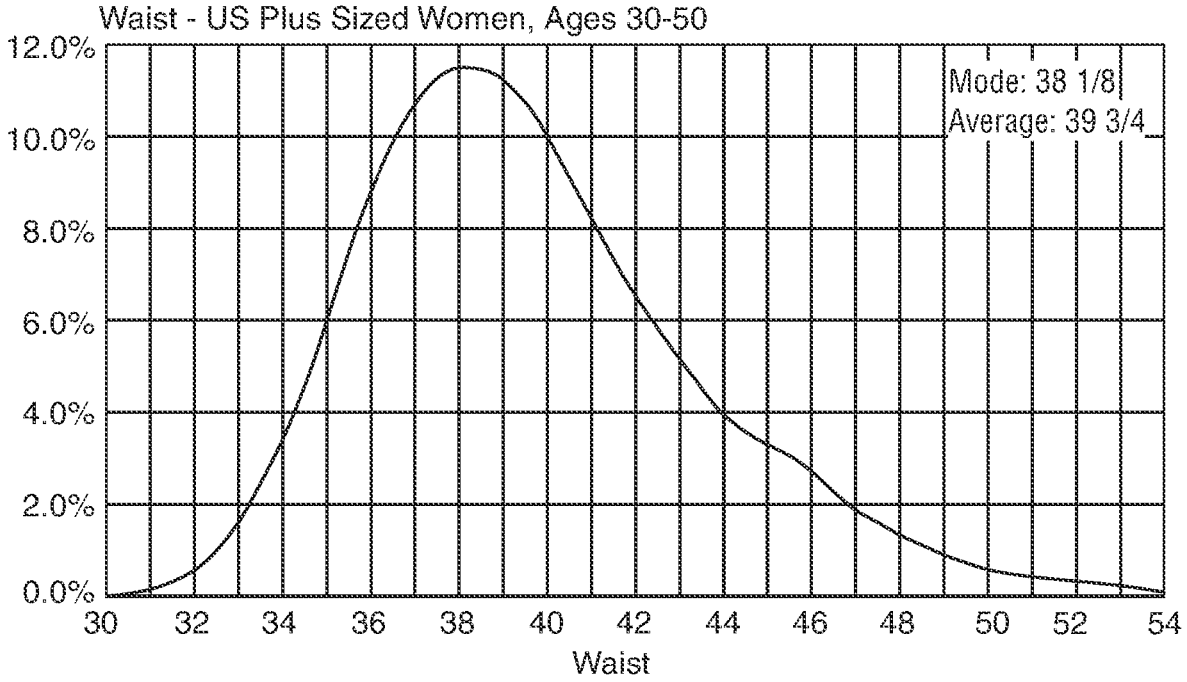
FIG. 4 shows still another illustrative graph in accordance with principles of the disclosure.

FIG. 4 an illustrative graph. The illustrative graph shows the percentage of waist measurements of plus size women. As noted earlier, the waist measurement may be understood to mean a crease in the body when the body is bent to one side.

The x-axis on the graph shows waist measurements in inches. The y-axis on the graph shows the percentage of plus size women for each waist measurement.

The mode waist measurement of US plus size women between the ages of 30 and 50 may be 38⅛ inches. The average waist measurement of US plus size women between the ages of 30 and 50 may be 39¾ inches.

Figure 5:
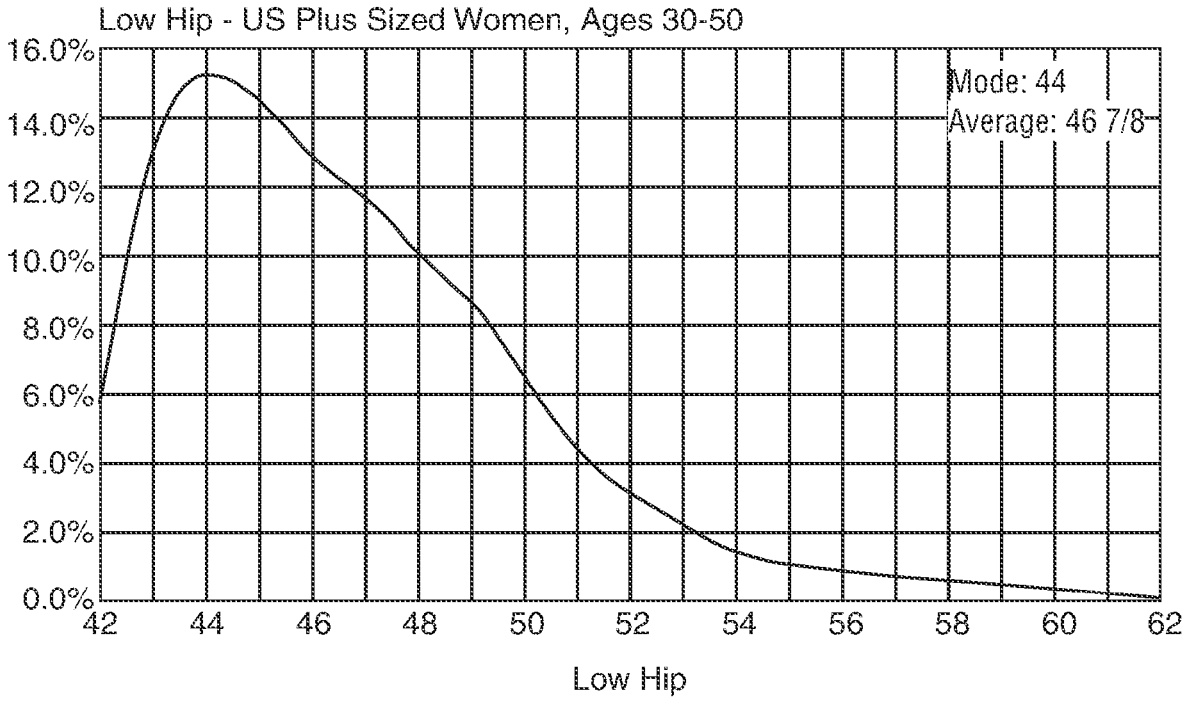
FIG. 5 shows yet another illustrative graph in accordance with principles of the disclosure.

FIG. 5 shows an illustrative graph. The illustrative graph shows the percentage of low hip measurements of plus size women. As noted earlier in the application, a low hip measurement may be understood to mean the widest point on a body below a waist measurement.

The x-axis on the graph shows low hip measurements in inches. The y-axis on the graph shows the percentage of plus size women for each low hip measurement.

The mode low hip measurement of US plus size women between the ages of 30 and 50 may be 44 inches. The average low hip measurement of US plus size women between the ages of 30 and 50 may be 46⅞ inches.

Figure 6:
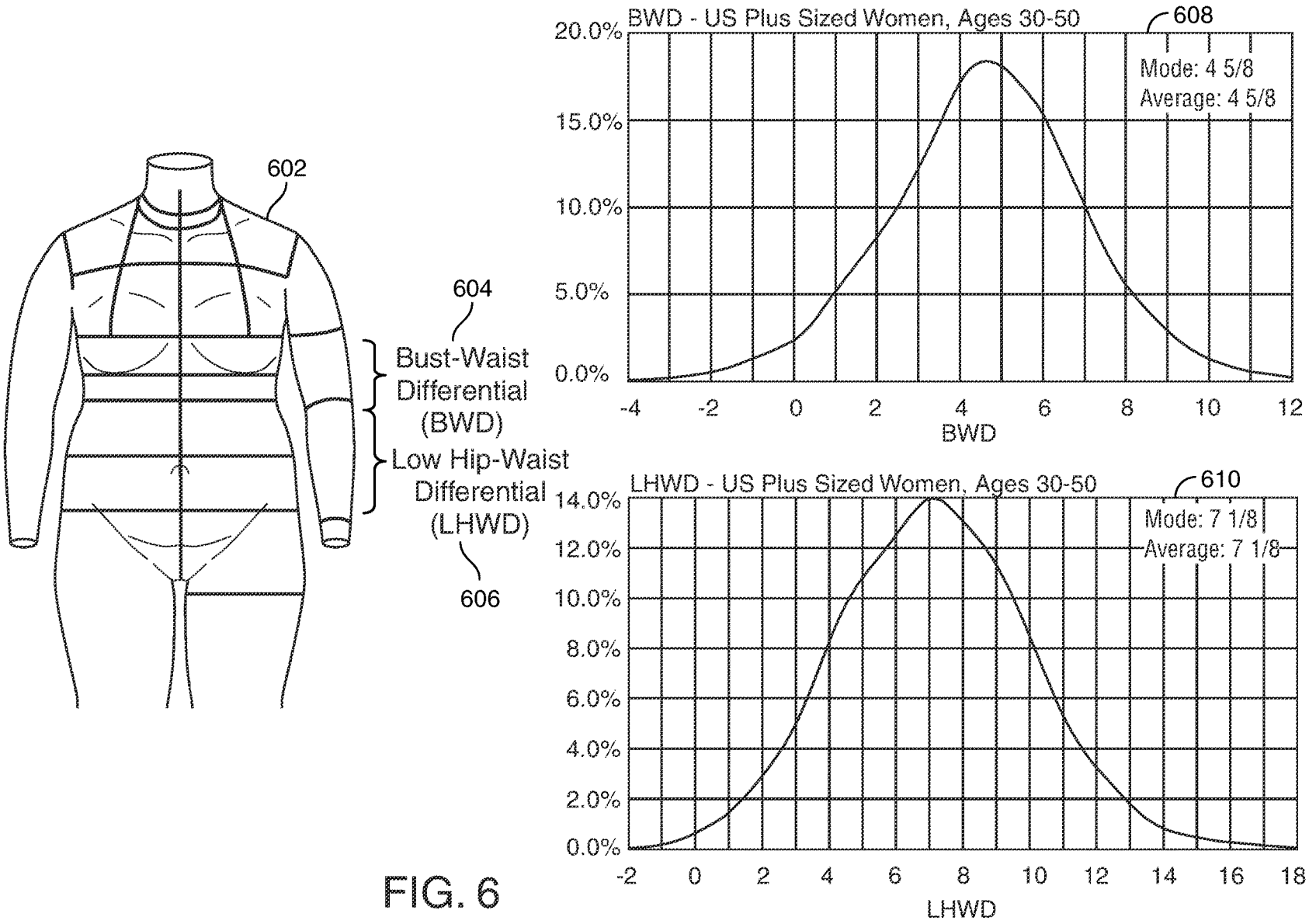
FIG. 6 shows an illustrative hybrid graph-diagram in accordance with principles of the disclosure.

FIG. 6 shows an illustrative hybrid graphs diagram. Body form 602 may be a form of a body. Body form 602 may include various measurements.

Body form 602 may show a bust-waist differential (BWD), as shown at 604. BWD 604 may be the difference between a bust measurement and a waist measurement. Illustrative graph 610 may show BWD measurements retrieved from a plurality of body scans. The x-axis may include the BWD in inches. The BWD in inches may range from −4 inches to 12 inches. The y-axis may include percentage of plus size women for each BWD measurement. The mode BWD and the average BWD may be 4⅝ inches.

Body form 606 may show a low hip-waist differential (LHWD), as shown at 606. LHWD may be the difference between a waist measurement and a low hip measurement. Illustrative graph 610 may show LHWD measurements retrieved from a plurality of body scans. The x-axis may include the LHWD in inches. The LHWD may range from −2 to 18 inches. The y-axis may include the percentage of plus size women for each LHWD measurement. The mode LHWD and the average LHWD may be 7⅛ inches.

Figure 7:
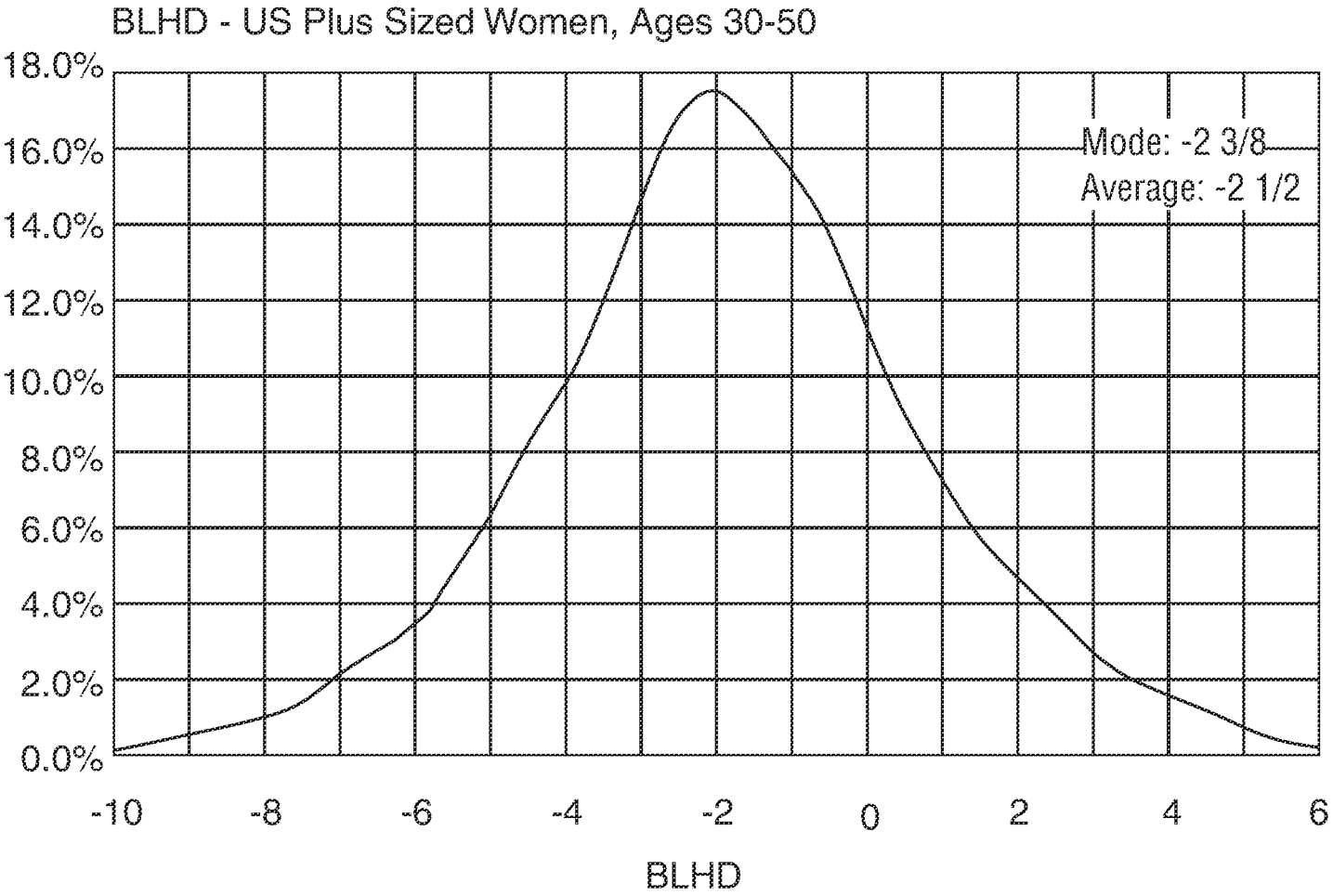
FIG. 7 shows an illustrative graph in accordance with principles of the disclosure.

FIG. 7 shows an illustrative graph. The illustrative graph shows the bust to low hip differential (BLHD). The BLHD may be difference between the bust measurement and the low hip measurement. The x-axis on the graph shows the BLHD in inches. The BLHD may range from −10 to 6 inches. The y-axis may include a percentage of plus size women for each BLHD measurement. The mode BLHD measurement may be −2⅜ inches. The average BLHD measurement may be −2½ inches.

Figure 8:
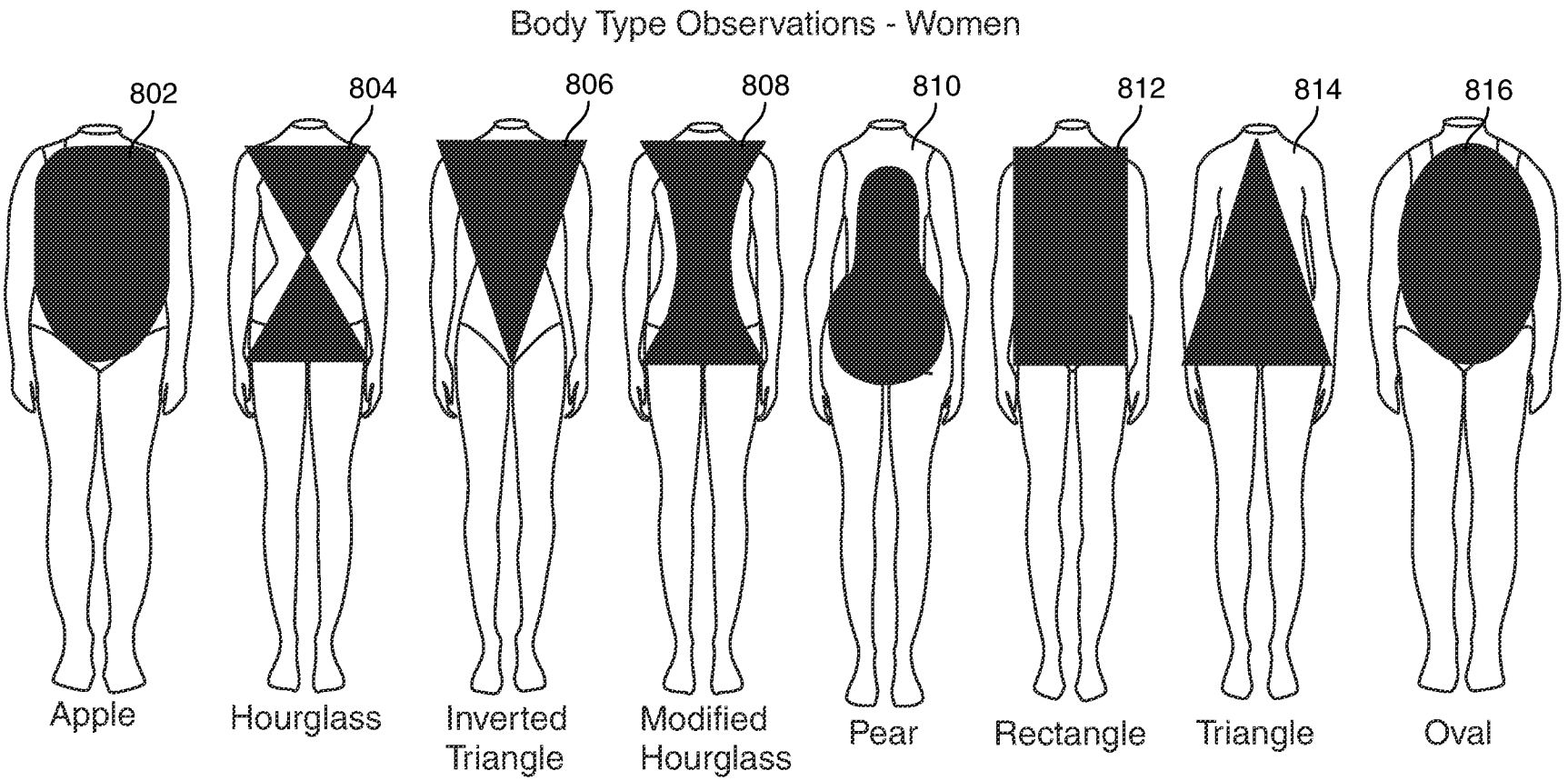
FIG. 8 shows an illustrative diagram in accordance with principles of the disclosure.

FIG. 8 shows an illustrative diagram. The illustrative diagram shows various women's body types. A body type may be a shape of a body. Various bodies may correlate to a specific body shape. The body types may include apple 802, hourglass 804, inverted triangle 806, modified hourglass 808, pear 810, rectangle 812, triangle 814 and oval 816.

Figure 9:
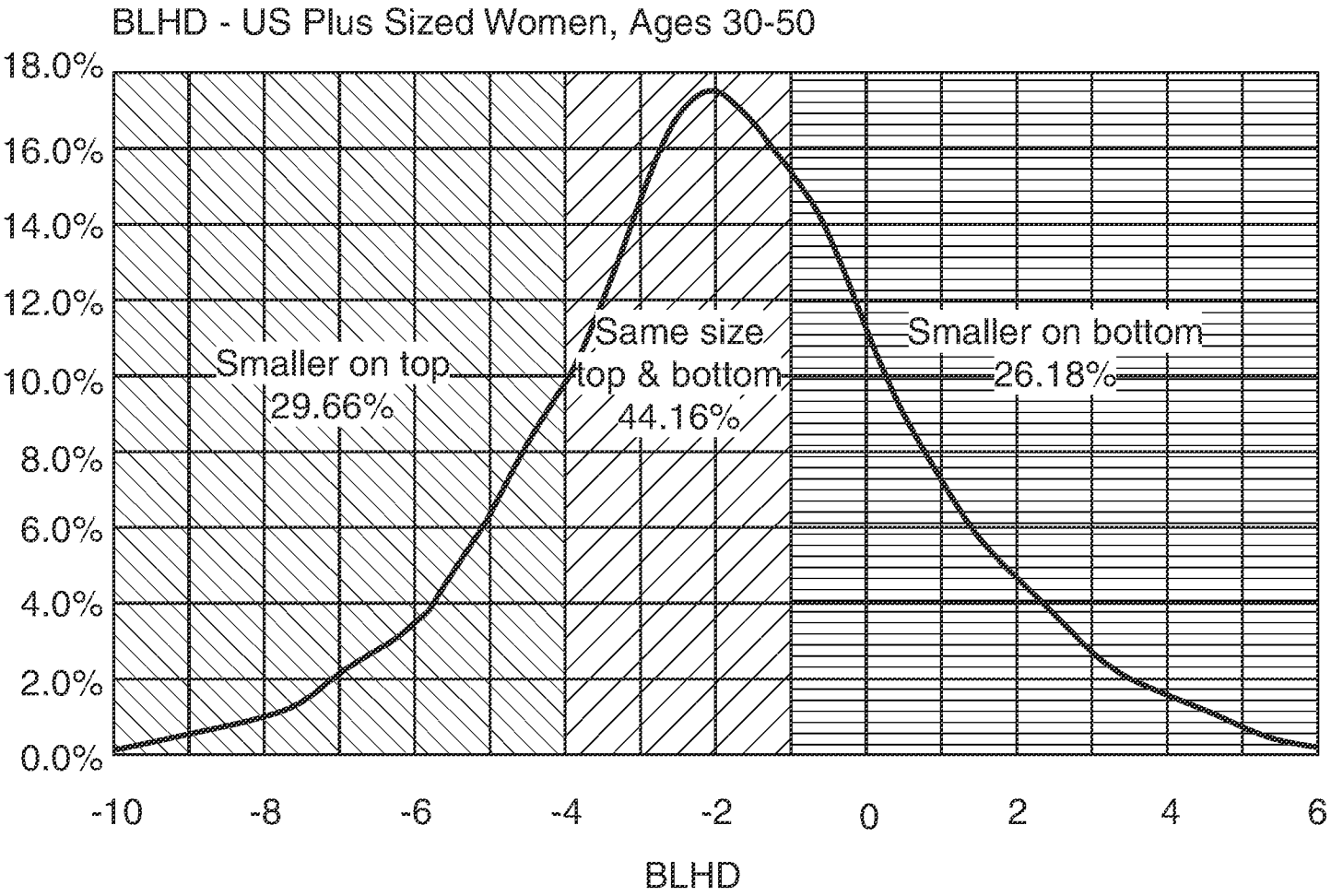
FIG. 9 shows an illustrative graph in accordance with principles of the disclosure.

FIG. 9 shows an illustrative graph. The illustrative graph shows a similar graph to the graph shown in FIG. 7. However, the graph shown in FIG. 9 shows the percentages of women that fit into various ranges of the bust to low hip differential.

As shown on the graph, 44.16% of women are the same size on top (bust measurement) and bottom (low hip measurement). These women have a BLHD of between approximately −4 inches and −1 inches.

Also shown on the graph, 29.66% of plus size women are smaller on top (bust measurement) than on bottom (low hip measurement). These women have a BLHD of between approximately −10 inches to −4 inches.

Also shown on the graph, 26.18% of plus size women are smaller on bottom (low hip measurement) than on top (bust measurement). These women have a BLHD of between approximately −1 inches to 6 inches.

Figure 10:
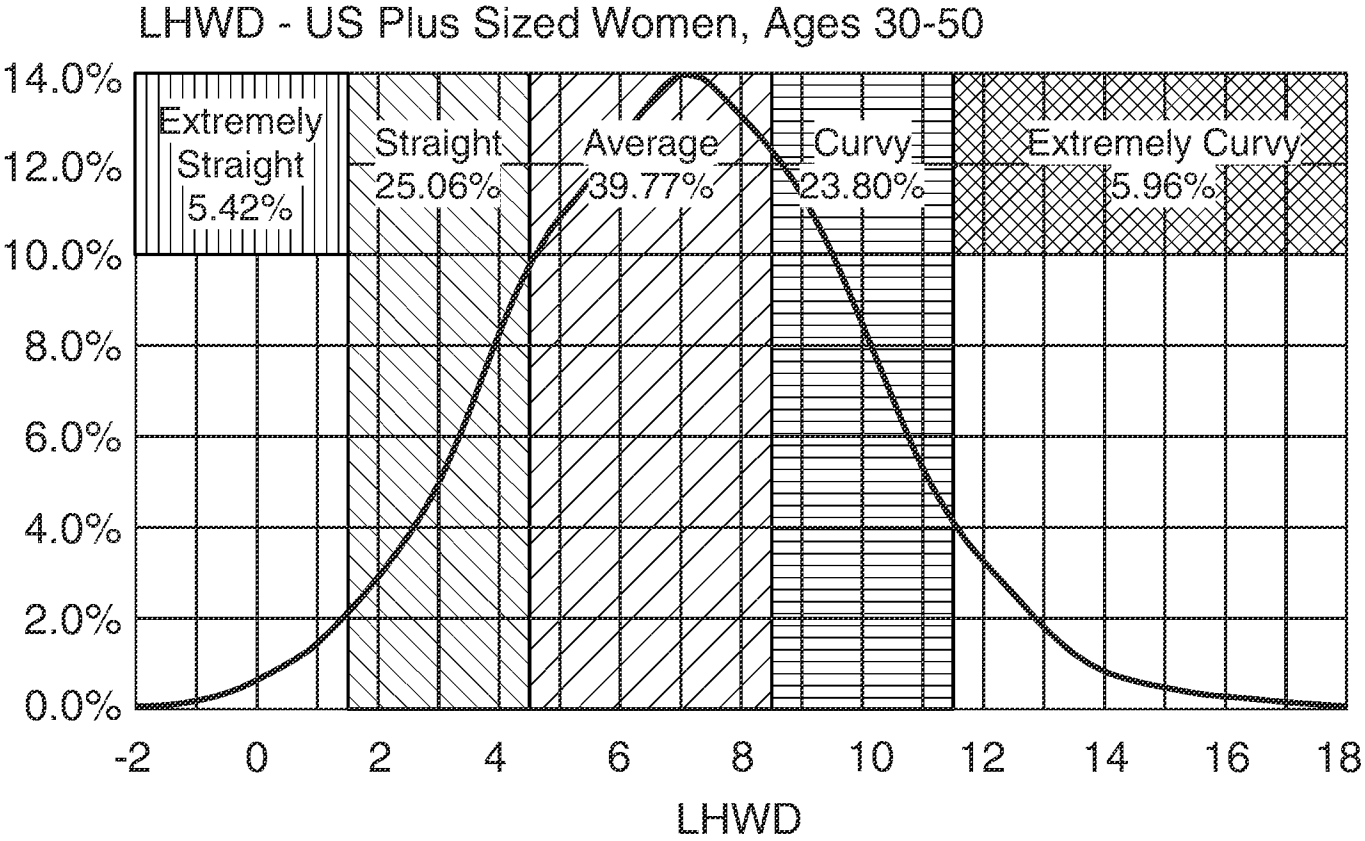
FIG. 10 shows another illustrative graph in accordance with principles of the disclosure.

FIG. 10 shows an illustrative graph. The illustrative graph shows a graph similar to the graph shown at 610 of FIG. 6. However, the graph shown in FIG. 10 shows the percentages of women that fit into various ranges of low hip to waist differential.

As shown on the graph, 5.42% of women may be categorized as extremely straight with respect to the LHWD. 25.06% of women may be categorized as straight with respect to the LHWD. 39.77% of women may be categorized as average with respect to the LHWD. 23.90% of women may be categorized as curvy with respect to the LHWD. 5.96% of women may be categorized as extremely curvy with respect to the LHWD.

It should be noted that when the LHWD is −2 as shown on the x-axis, the waist measurement may be 2 inches greater than the low hip measurement. Although typically, the low hip measurement may be the widest point on the body below the waist measurement, at times, the low hip measurement may be between about 7 and 11 inches below the waist measurement.

Figure 11:
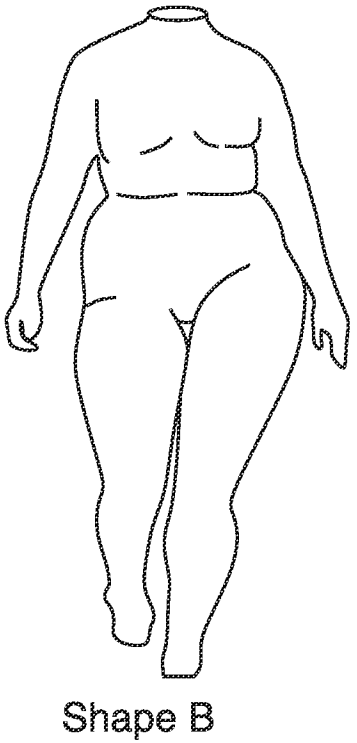
FIG. 11 shows an illustrative diagram in accordance with principles of the disclosure.
Figure 11:
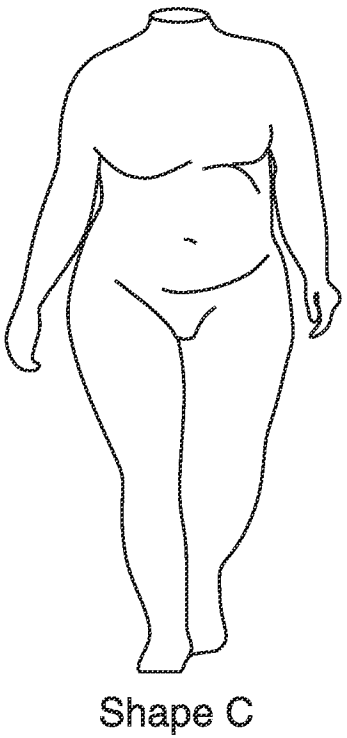
Figure 11:
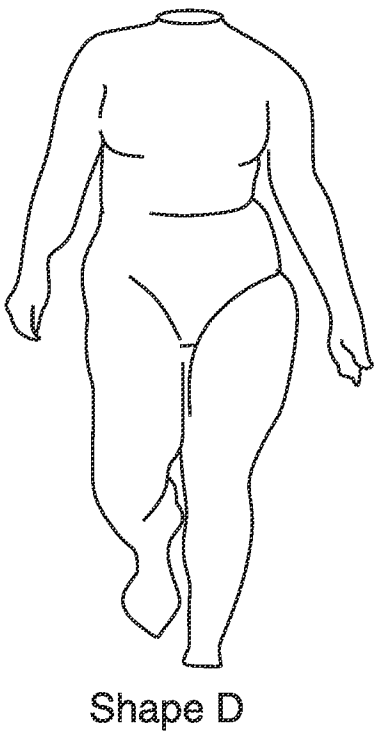

FIG. 11 shows an illustrative diagram. Based on the information received from body scans and the various graphs and diagrams shown in FIGS. 1-10, there may be three distinct body shapes that categorize most plus size women.

A first body shape may be identified as shape B. Shape B may include a waist and bust smaller than hips. Shape B may carry more weight in the thighs and backside. The widest point of a shape B body may be the hips.

A second body shape may be identified as shape C. Shape C may include similar measurements from bust to waist to hips. Shape C may carry most of the weight in the belly. The widest point of shape C body may be the waist.

A third body shape may be identified as shape D. Shape D may include proportional bust and hip measurements and a smaller waist measurement. The weight in shape D may be evenly distributed. The widest point on the body may be the bust and/or the hips.

Figure 12:
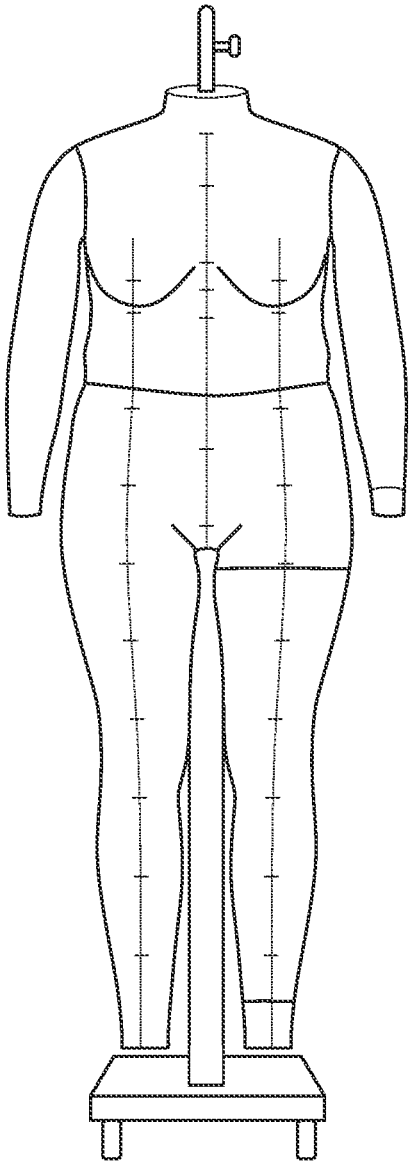
FIG. 12 shows another illustrative diagram in accordance with principles of the disclosure.

FIG. 12 shows an illustrative diagram. The illustrative diagram includes an illustrative plus size dress form. The dress form may be used to create clothing for plus size women. There may be multiple dress forms. Each of the multiple dress forms may correspond to a body shape. It should be noted that the illustrative plus size dress form shown in FIG. 12 may correspond to a shape D body, as described earlier in the application.

Furthermore, it should be noted that the dress form shows upper thighs that do not touch. On a human, upper thighs may touch. However, the limitation of a dress form is that the dress form is made from a hard material. Therefore, in order to place pants onto the dress form, the upper thighs of the dress form cannot touch. When the same pants are worn by a human with touching upper thighs, the human will be able maneuver the soft flesh of the human thighs into the pants.

Figure 13:
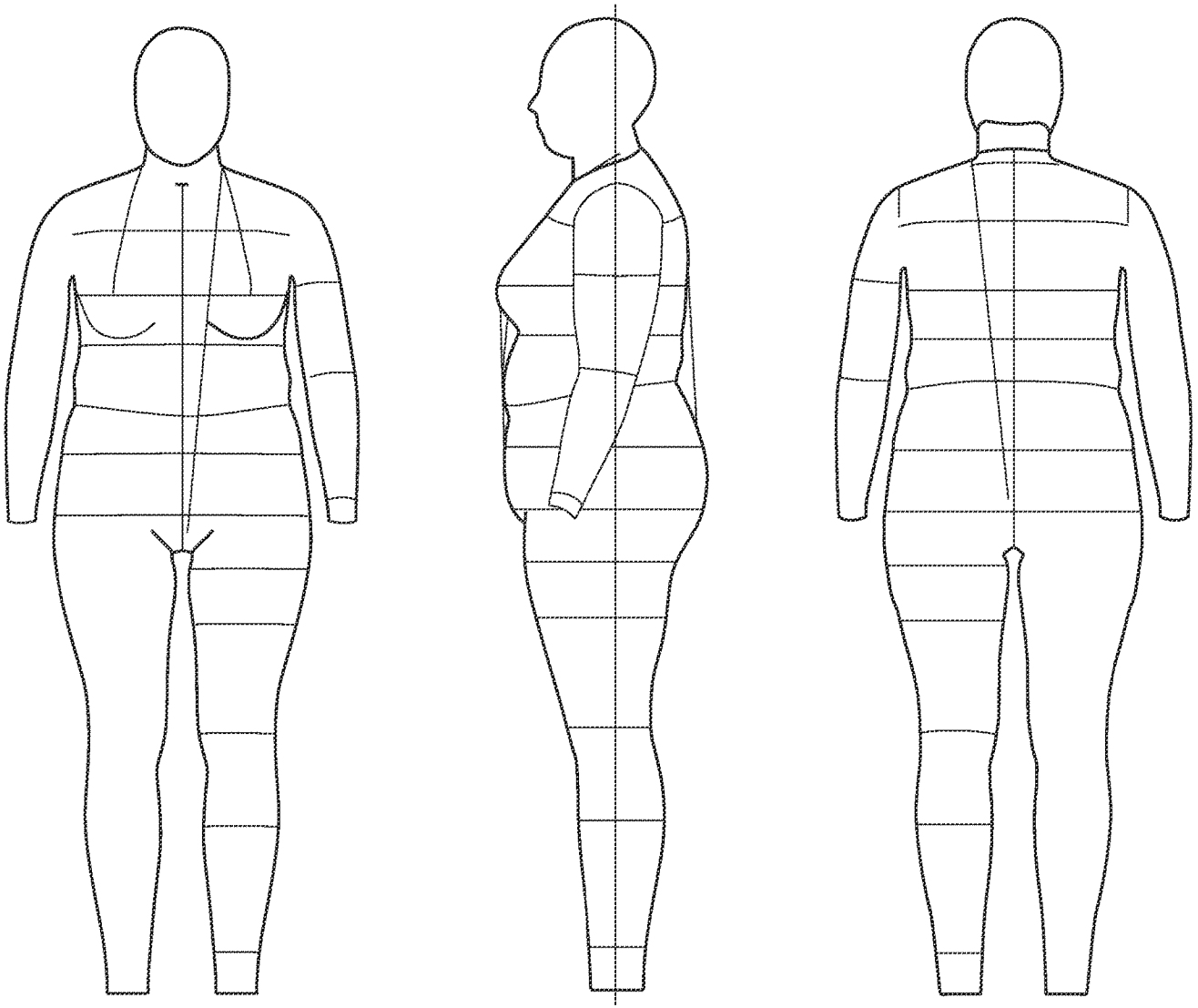
FIG. 13 shows yet another illustrative diagram in accordance with principles of the disclosure.

FIG. 13 shows an illustrative diagram. The illustrative diagram includes various views of an illustrative plus size dress form. The illustrative plus size dress form may correspond to a shape B body, as shown and described in FIG. 11.

Figure 14:
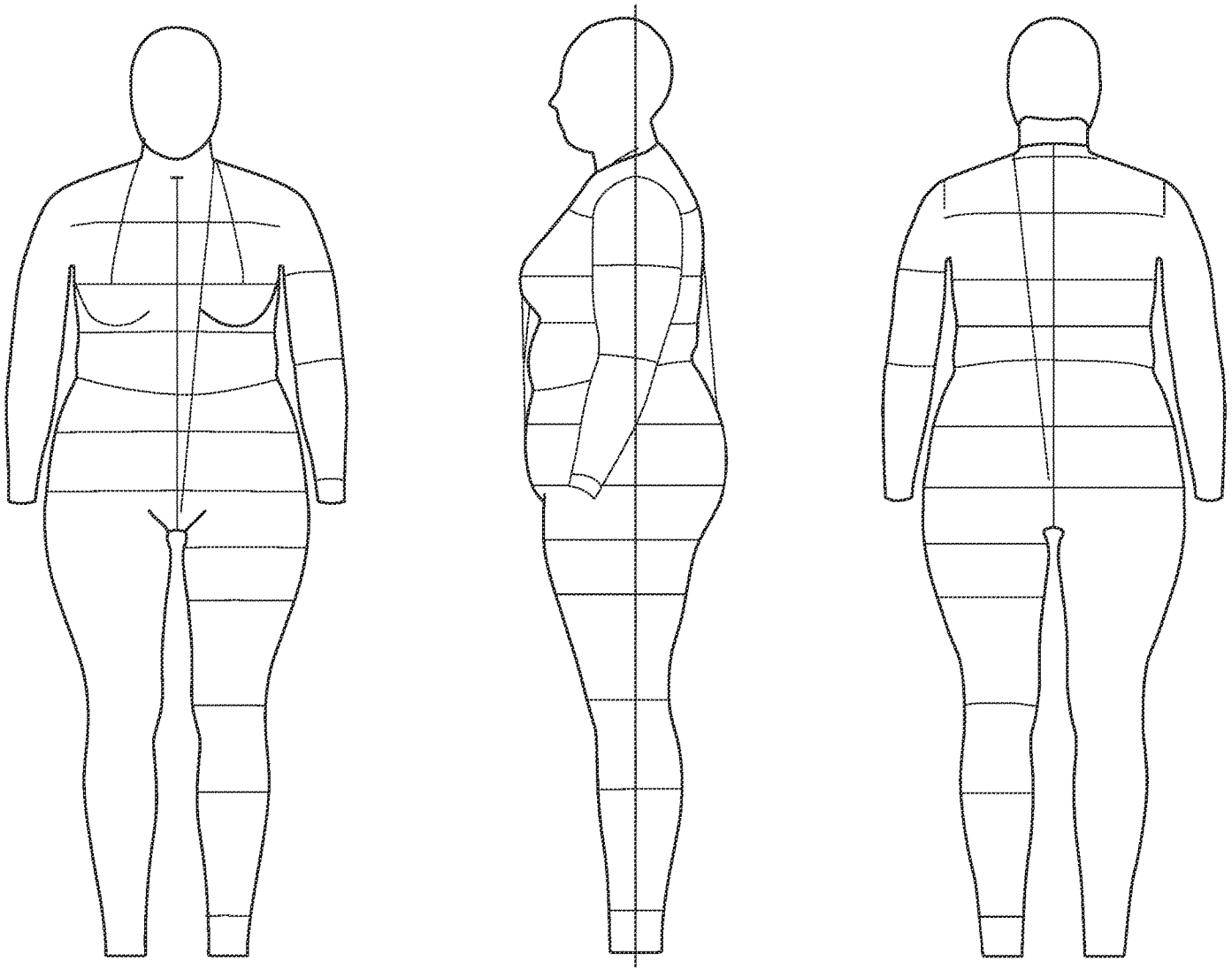
FIG. 14 shows still another illustrative diagram in accordance with principles of the disclosure.

FIG. 14 shows an illustrative diagram. The illustrative diagram includes various views of an illustrative plus size dress form. The illustrative plus size dress form may correspond to a shape D body, as shown and described in FIG. 11.

Figure 15:
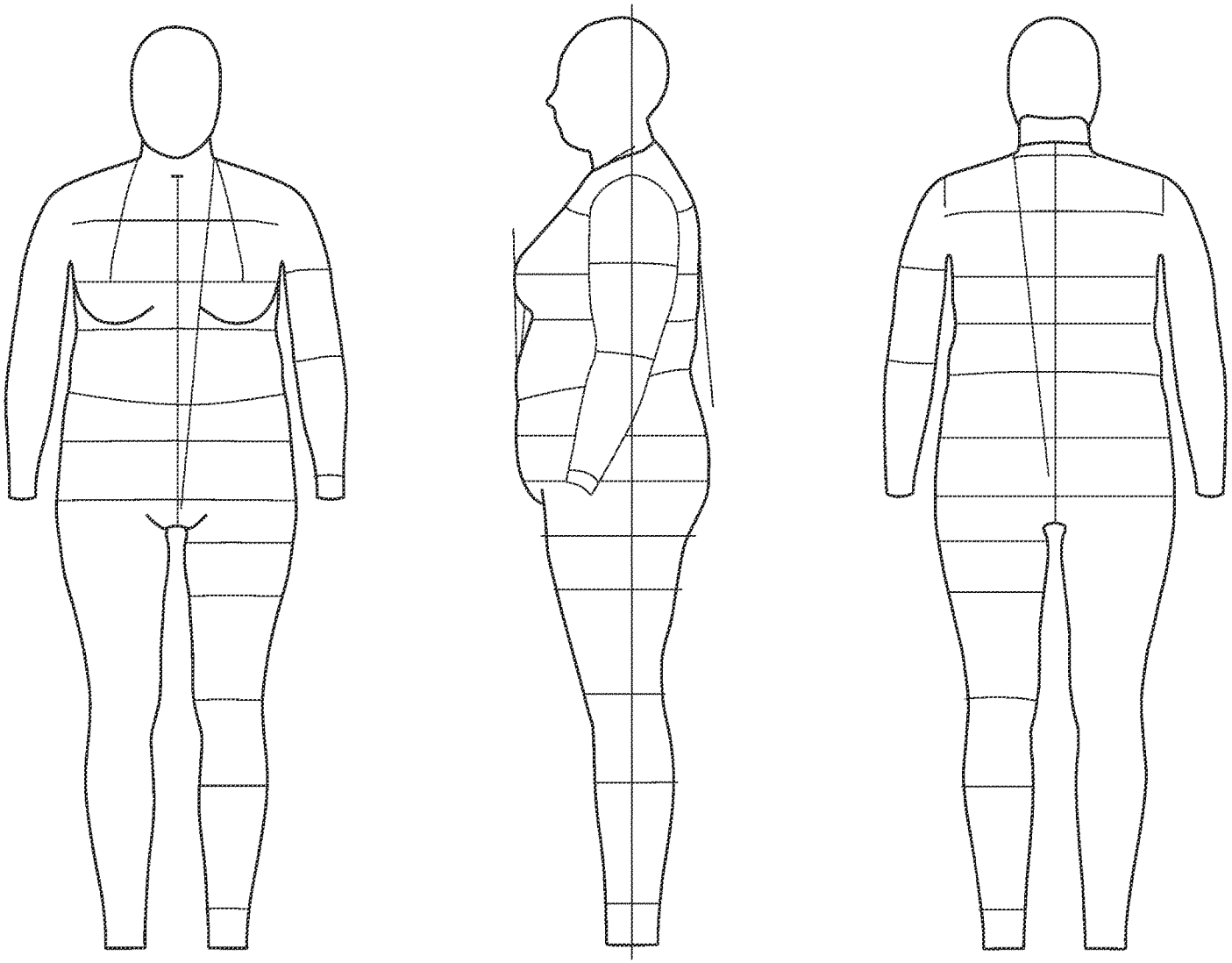
FIG. 15 shows yet another illustrative diagram in accordance with principles of the disclosure.

FIG. 15 shows an illustrative diagram. The illustrative diagram includes various views of an illustrative plus size dress form. The illustrative plus size dress form may correspond to a shape C body, as shown and described in FIG. 11.

Figure 16:
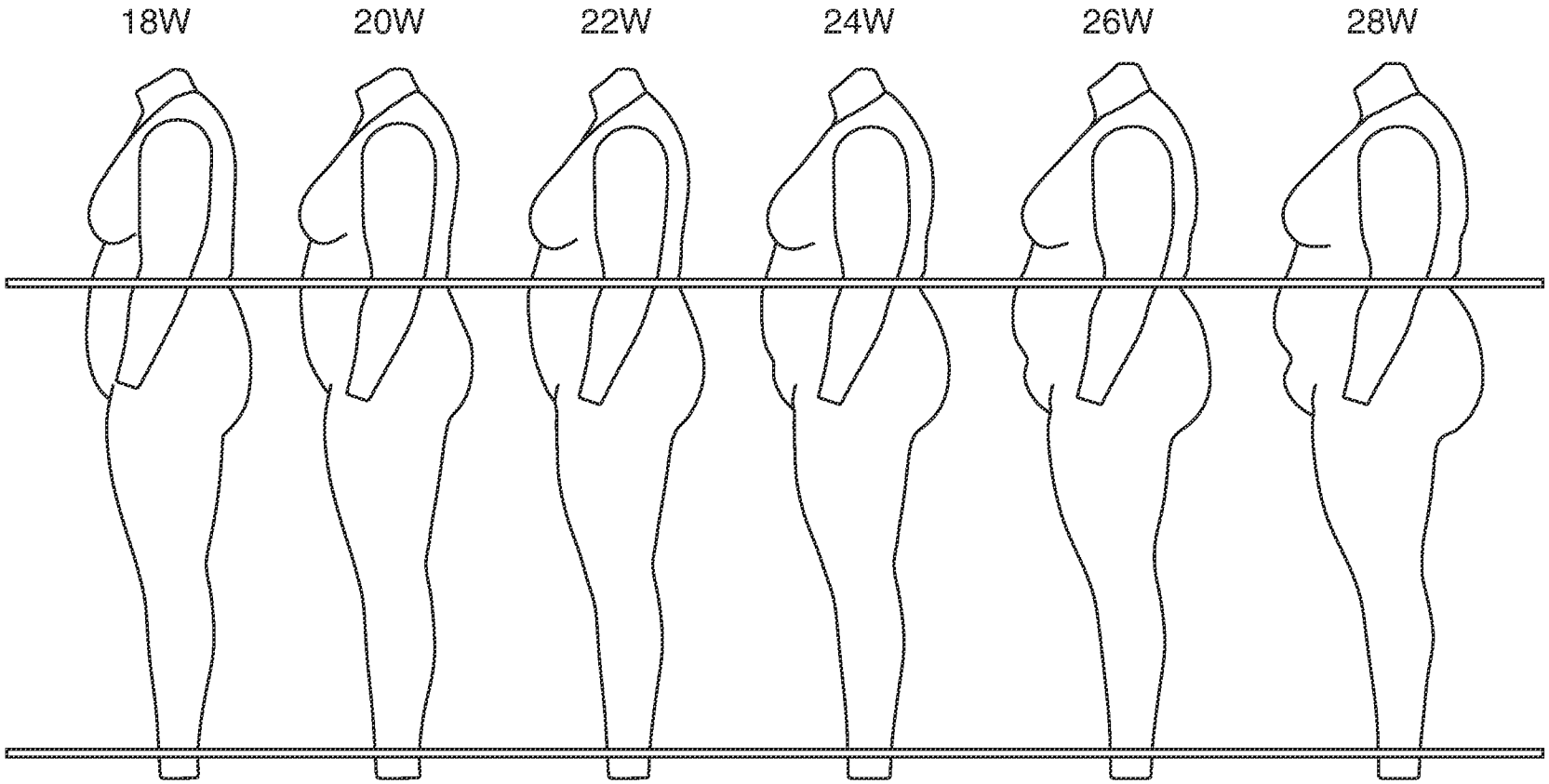
FIG. 16 Prior Art
FIG. 16 shows a prior art diagram.

FIG. 16 shows a prior art diagram. The illustrative diagram shows various models that correspond to various plus sizes. The plus sizes shown are 18 W, 20 W, 22 W, 24 W, 26 W and 28 W. It should be noted that this diagram shows prior art models. The models shown in FIG. 16 are what is currently available commercially. If one draws a line through the women shown, these women are growing proportionately in the belly and backside, however, the biceps, breasts, arms and legs do not change significantly. Based upon the data shown in FIGS. 1-10, it should be noted that such proportional growth is incorrect and produces ill-fitting garments.

Figure 17:
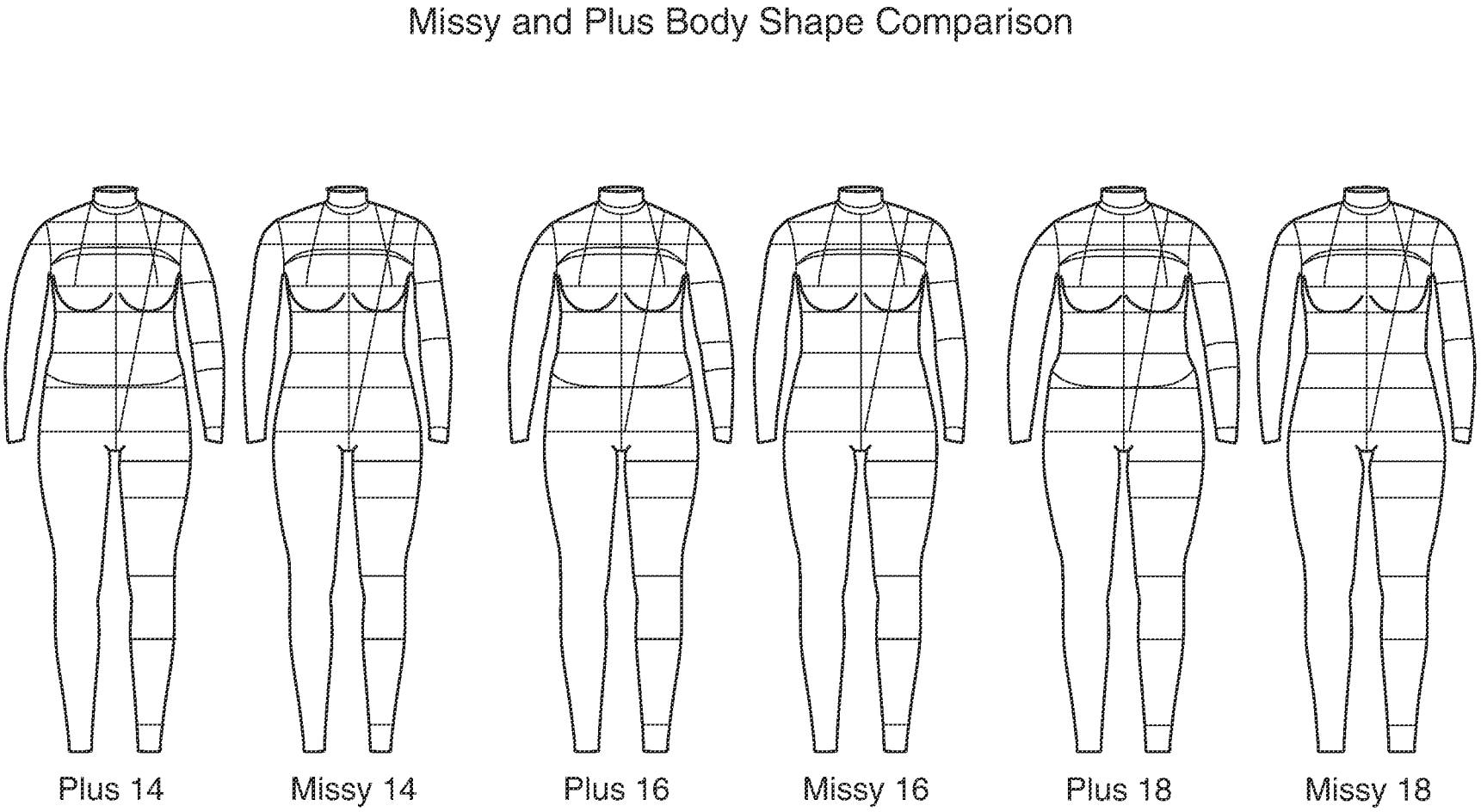
FIG. 17 Prior Art
FIG. 17 shows another prior art diagram.

FIG. 17 shows a prior art diagram. The prior art diagram shows shape comparisons between missy body shapes and plus body shapes. The illustrative diagram shows a front view of plus size 14 compared to a front view of missy size 14, a front view of plus size 16 compared to a front view of missy size 16 and a front view of plus size 18 compared to a front view of missy size 18. It should be noted that typical sizing includes juniors, missy and women's (also known as plus) sizing. Missy sizing may go up to size 18, while women's or plus sizing may start at size 14. The overlap between missy and women's or plus sizing may create confusion for a customer. Furthermore, women's or plus sizes 14-18 may be proportionately larger than missy sizes 14-18.

Figure 18:
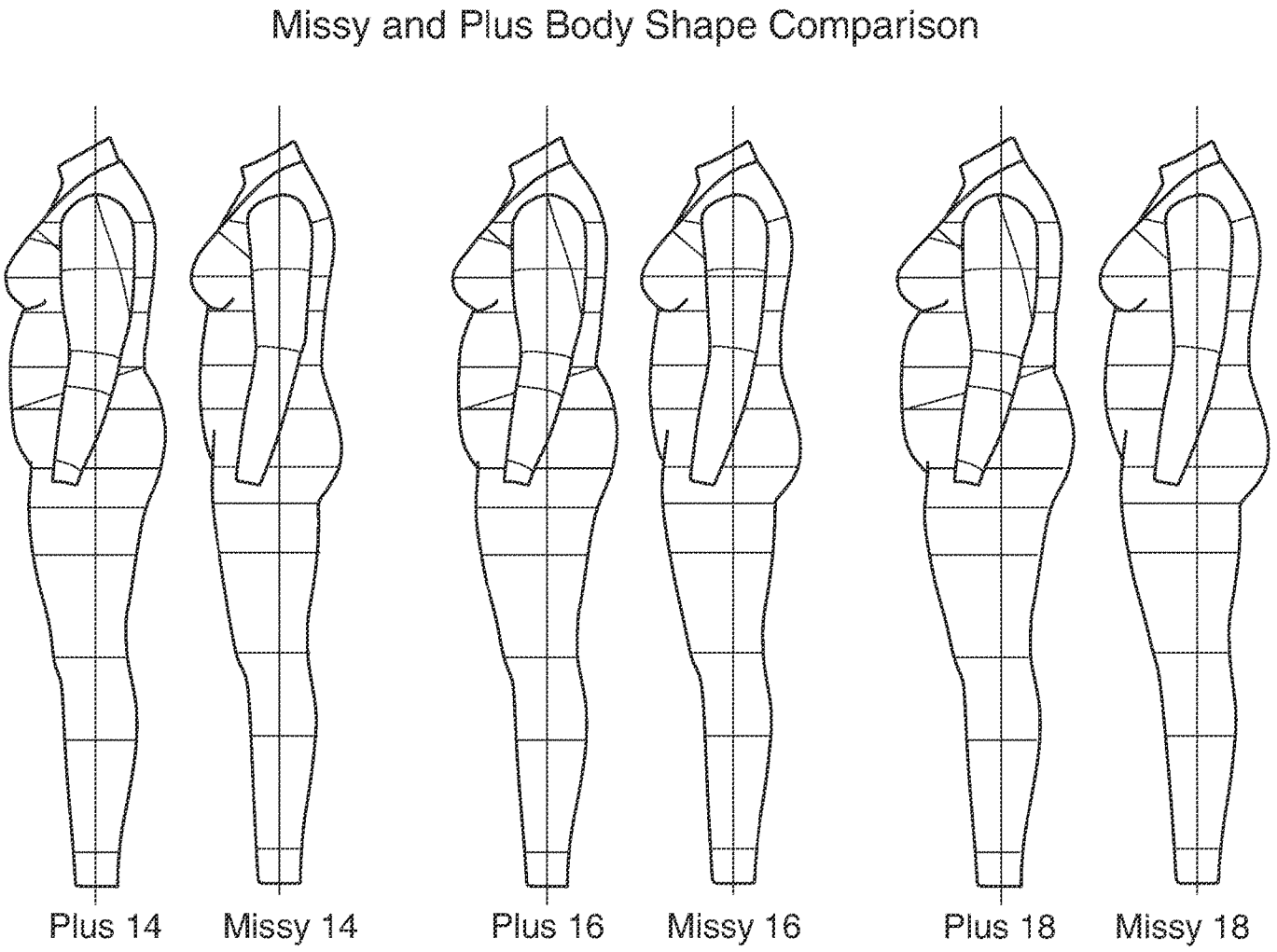
FIG. 18 Prior Art
FIG. 18 shows still another prior art diagram.

FIG. 18 shows a prior art diagram. The illustrative diagram shows shape comparisons between missy body shapes and plus body shapes. The illustrative diagram shows a side view of plus size 14 compared to a side view of missy size 14, a side view of plus size 16 compared to a side view of missy size 16 and a side view of plus size 18 compared to a side view of missy size 18.

FIGS. 19-23 shows illustrative GUIs. The illustrative GUIs may be used to receive information from a user. The information received from a user may be used to calculate a body shape and body size applicable for the user. The body shape and body size may be used when selecting articles of clothing from a store. The store may be a web-based store. The store may be a brick-and-mortar store.

Figure 19:
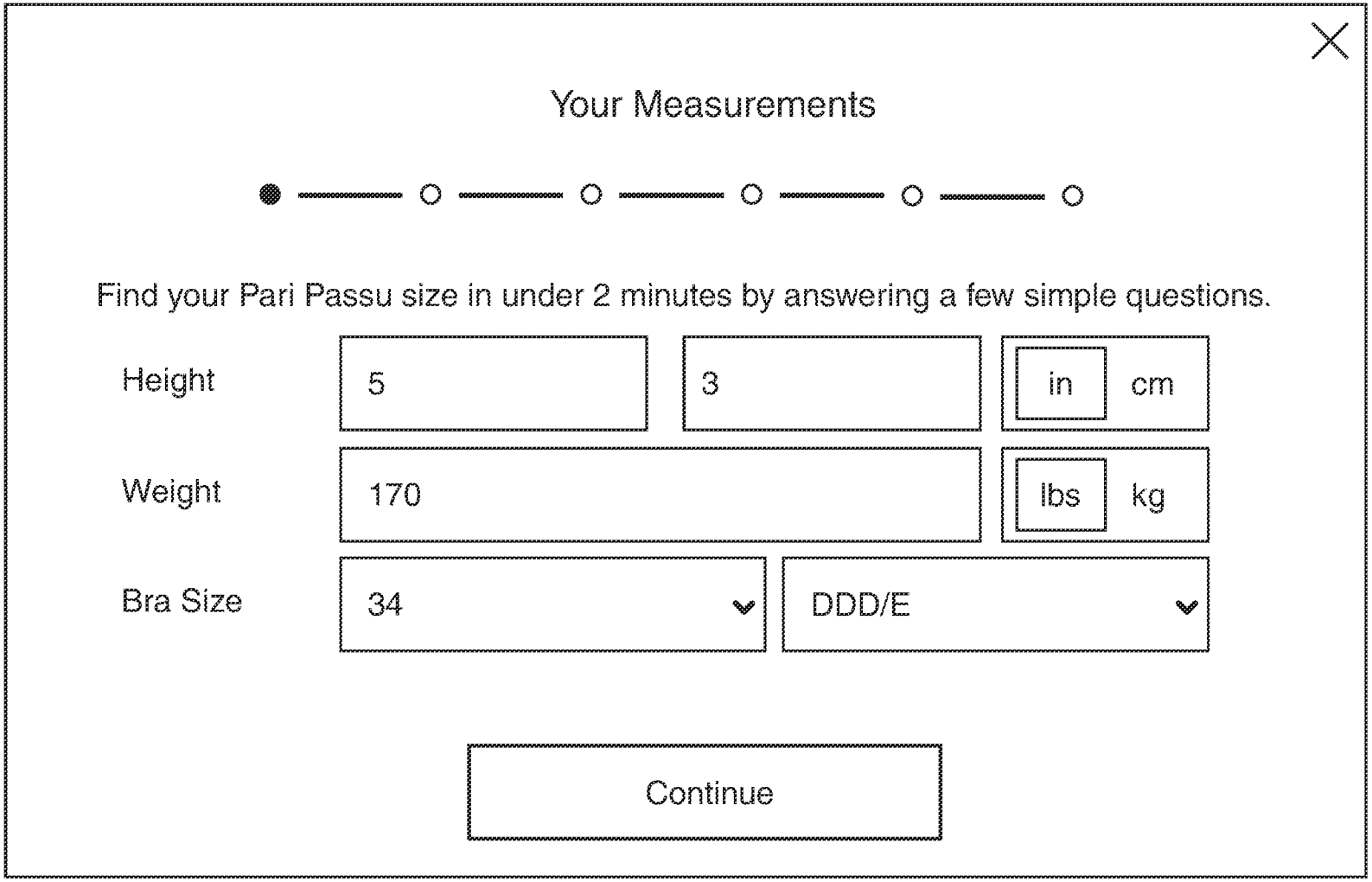
FIG. 19 shows an illustrative graphical user interface ("GUI") in accordance with principles of the disclosure.

FIG. 19 shows an illustrative GUI. The illustrative GUI may request a height measurement, weight measurement, bra length size and bra cup size from a user. Upon completion of entry of the information, the user may select continue.

Figure 20:
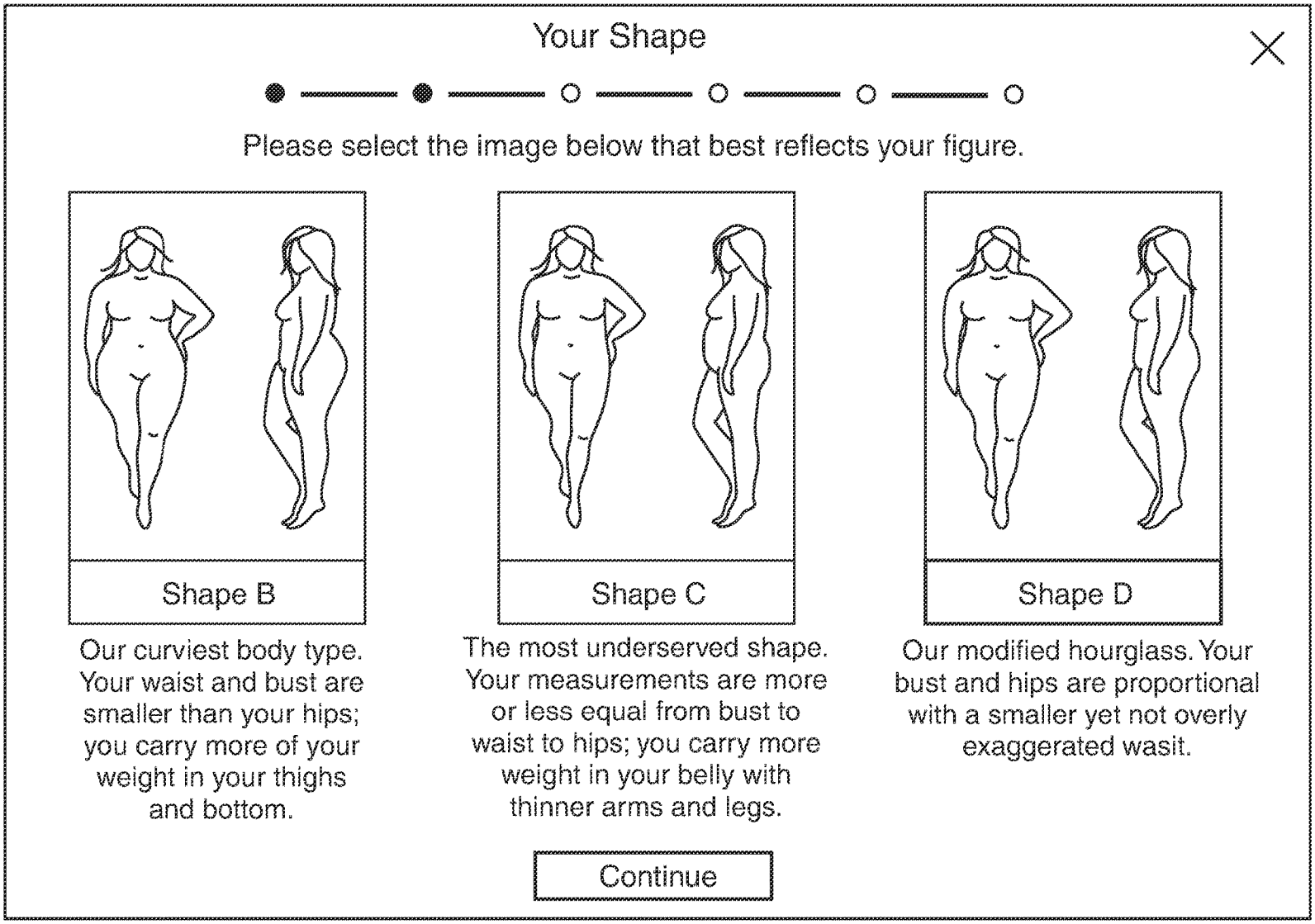
FIG. 20 shows an illustrative GUI in accordance with principles of the disclosure.

FIG. 20 shows another illustrative GUI. The illustrative GUI may request a user to select a body shape. There may be a description of each body shape. The user may select a body shape that the user thinks is most appropriate for the user's body.

Figure 21:
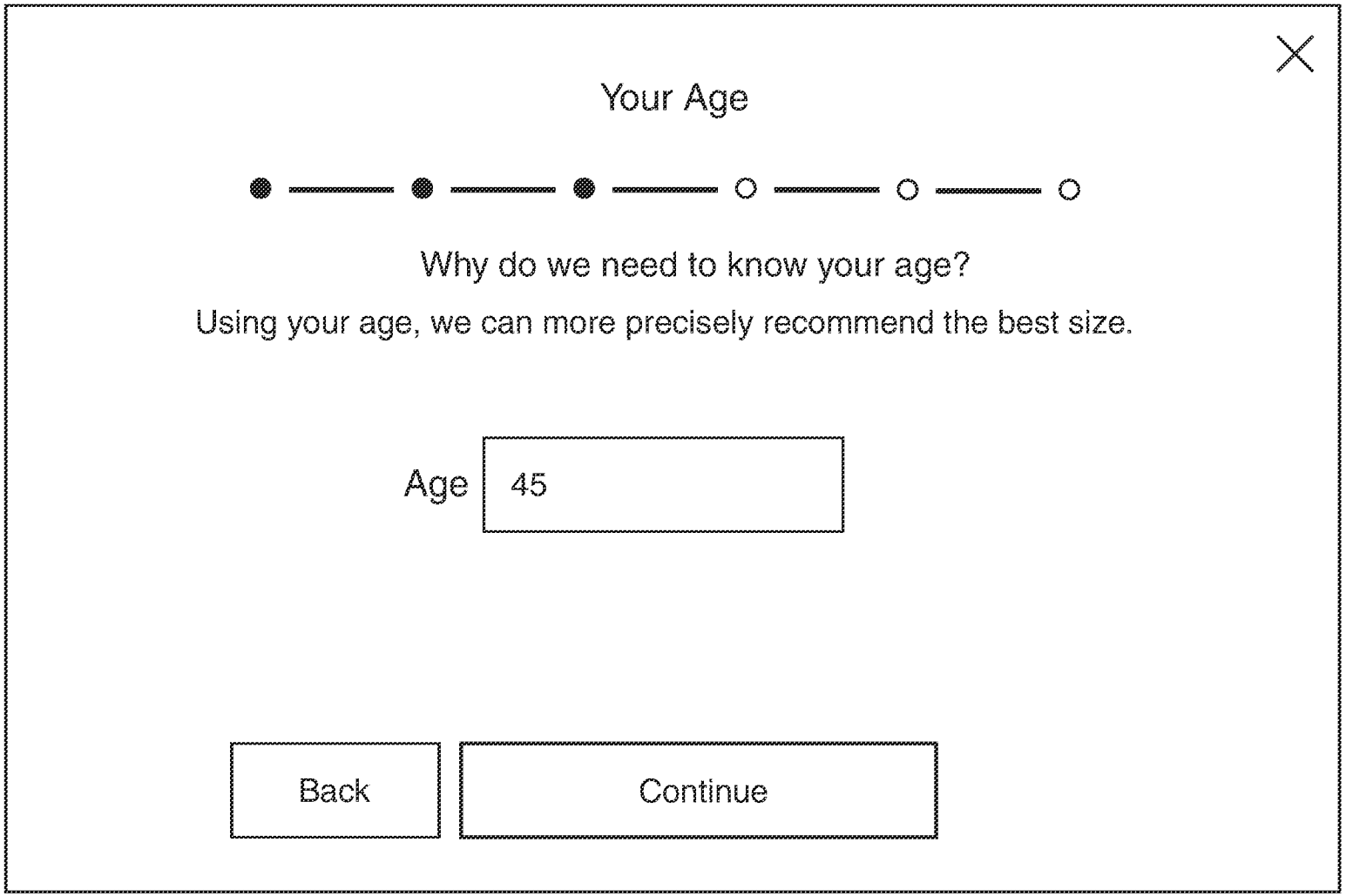
FIG. 21 shows another illustrative GUI in accordance with principles of the disclosure.

FIG. 21 shows another illustrative GUI. The illustrative GUI may request a user to enter an age. Because age is a factor in identifying a body shape and body size, an age may be used to recommend a best size for the user.

Figure 22:
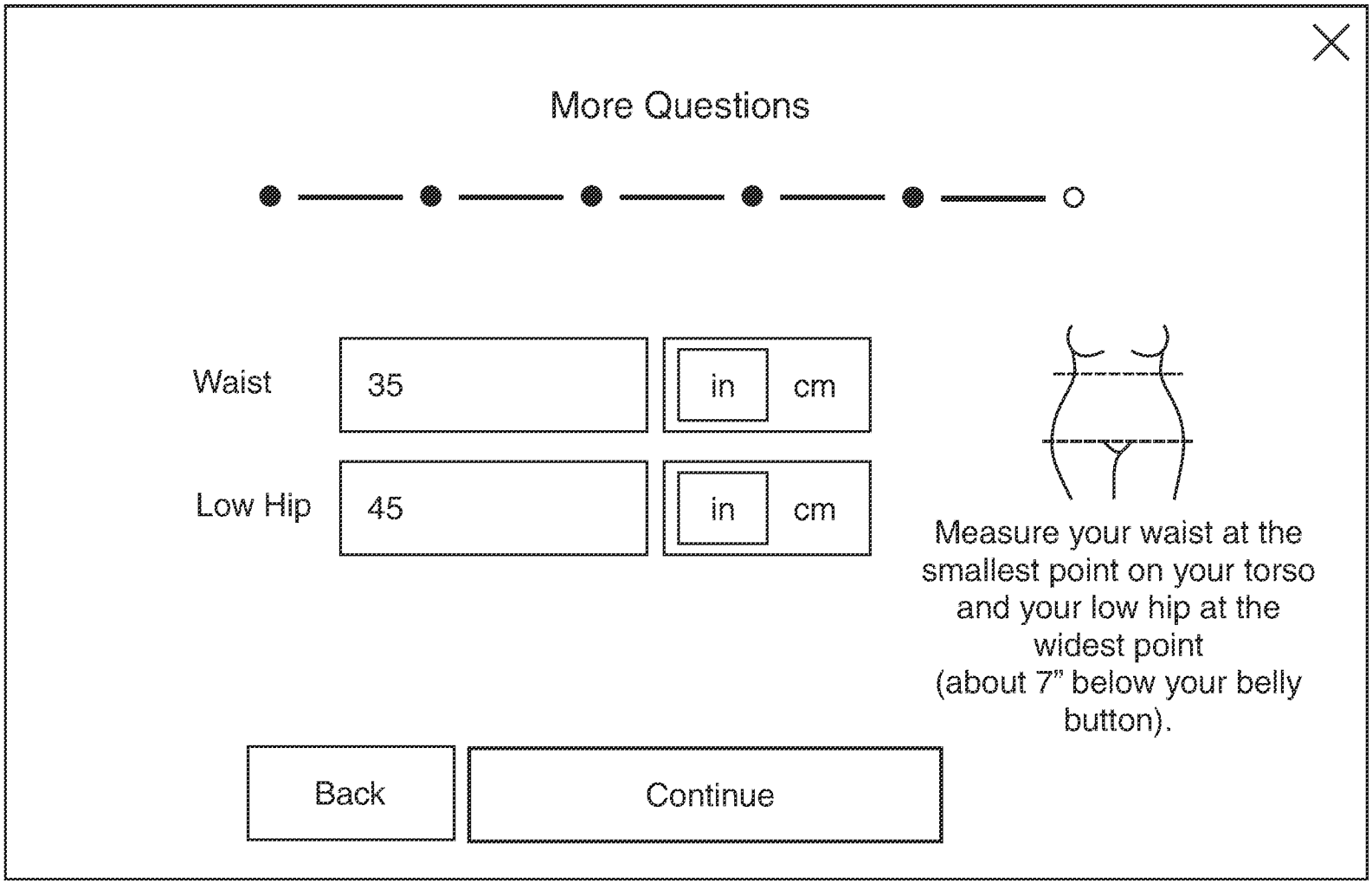
FIG. 22 shows yet another illustrative GUI in accordance with principles of the disclosure.

FIG. 22 shows another illustrative GUI. The illustrative GUI may include further questions. At times, a user may enter information into FIGS. 19-21 and the user may be presented with a body shape and body size. Other times, or if the user and/or system is not confident with the results of the presented body shape and body size, the user may be presented with the GUI shown in FIG. 22. The GUI may request a waist measurement and a low hip measurement. The waist measurement may be identified as the crease on the body when the body is bent towards one side. The low hip measurement may be identified as the widest point on the body below the waist measurement.

Figure 23:
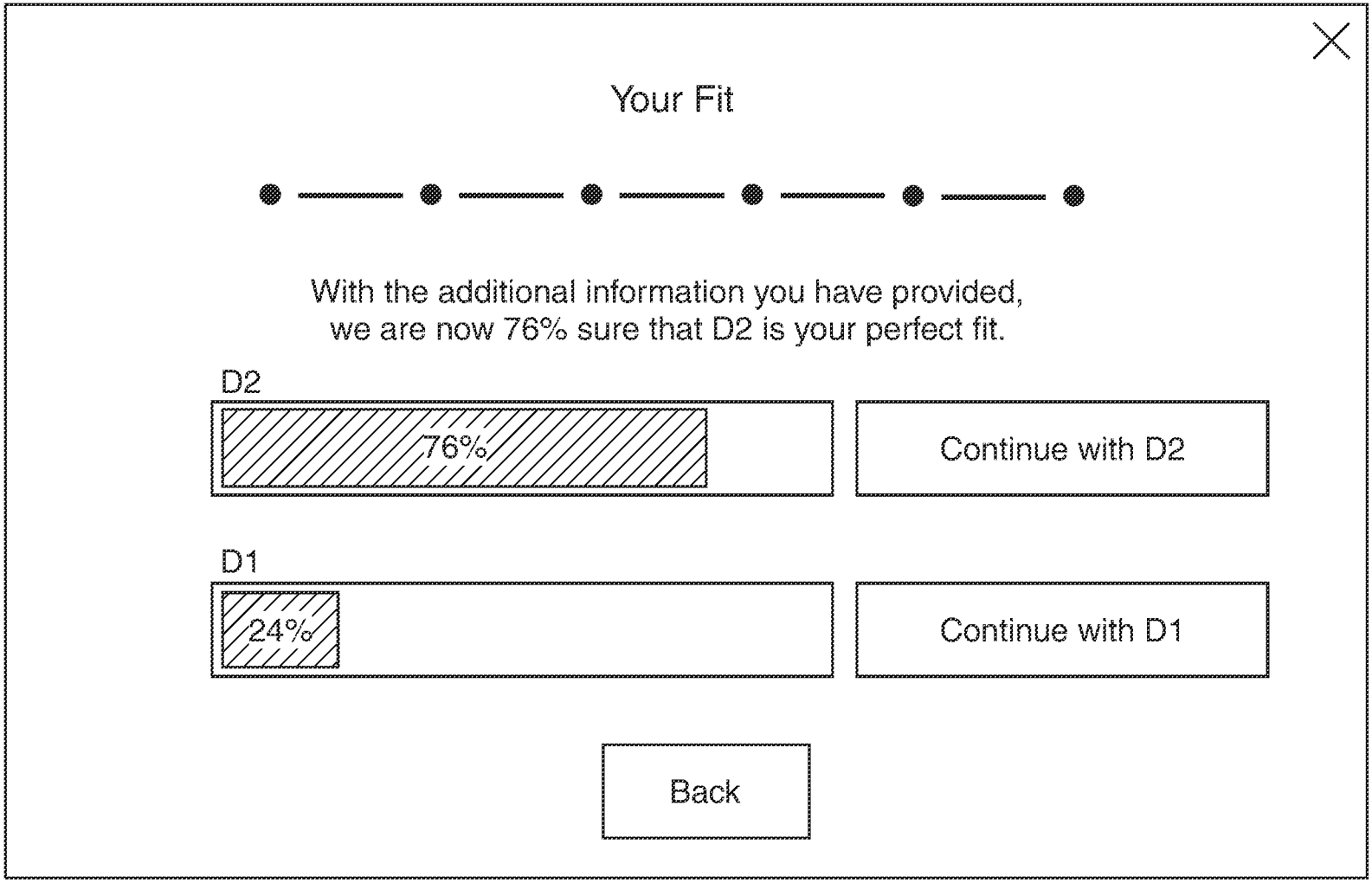
FIG. 23 shows still another illustrative GUI in accordance with principles of the disclosure.

FIG. 23 shows another illustrative GUI. The illustrative GUI may show one or more body shapes and one or more body sizes that correspond to the inputted information. Each combination of a body shape and body size may be accompanied by a percentage. The percentage may be a percentage of accuracy that the system is confident that this body shape and body size is appropriate for the received user information.

Figure 24:
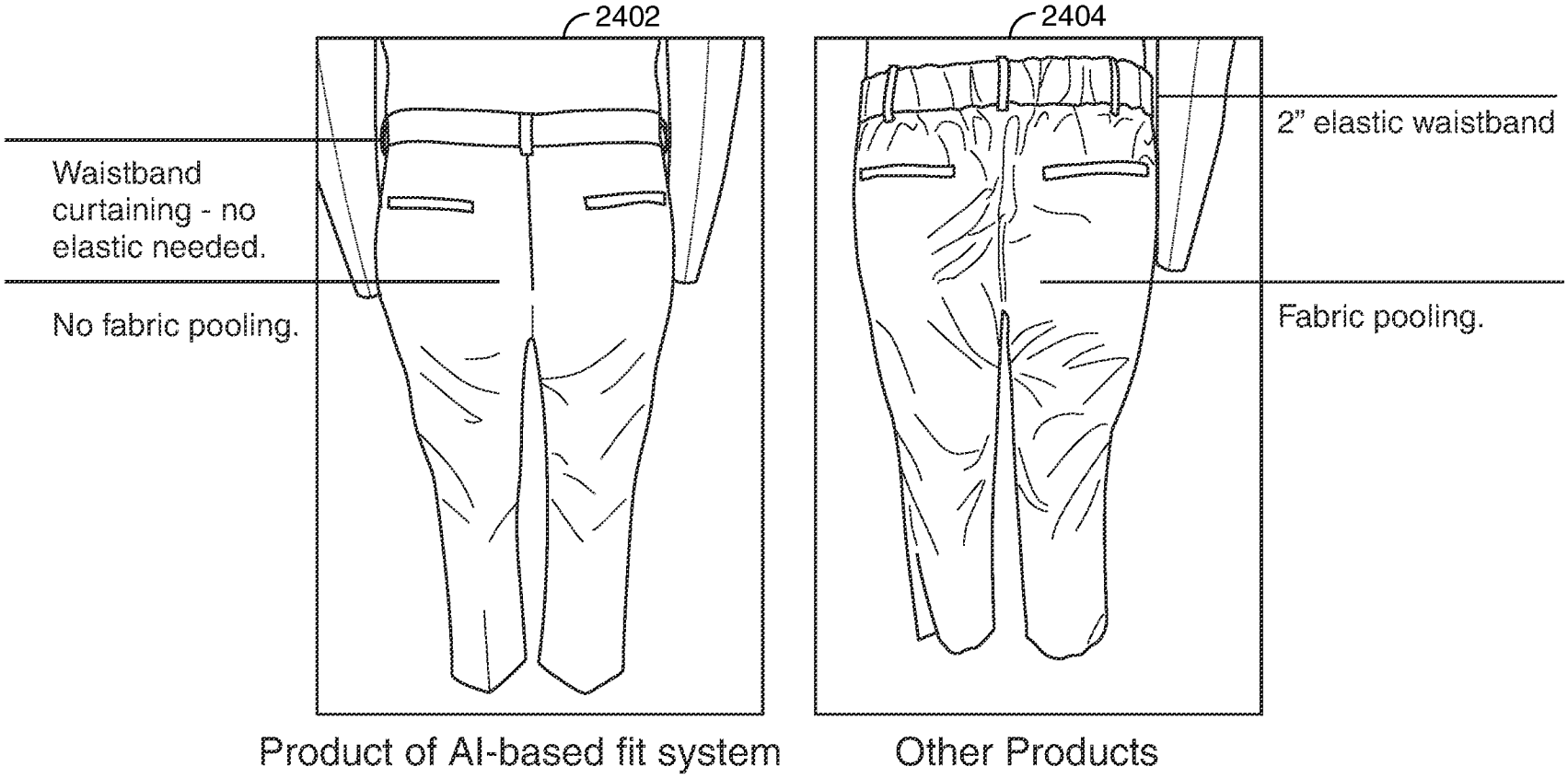
FIG. 24 shows an illustrative diagram in accordance with principles of the disclosure.

FIG. 24 shows another illustrative diagram. The illustrative diagram shows a comparison between clothing created using the AI-based fit system, shown at 2402, and other clothing, shown at 2404. Because the clothing created using the AI-based fit system is tailored for a specific body shape, there may be waistband curtaining and no elastic may be need. Additionally, there may be no fabric pooling. On the other hand, other clothing may include a 2-inch elastic waistband and fabric pooling.

Thus, an AI-based fit system including dress form creation is provided. Persons skilled in the art will appreciate that the present invention can be practiced by other than the described embodiments, which are presented for purposes of illustration rather than of limitation. The present invention is limited only by the claims that follow.

What is claimed is:

1. One or more non-transitory computer-readable media storing computer-executable instructions which, when executed by a processor on a computer system, perform a method for identifying one or more body sizes and one or more body shapes in response to received body measurement information relating to a body, the method comprising:

receiving, at an artificially-intelligent, sizing application, body measurement information relating to the body said body measurement information comprising:
a height measurement;
a weight measurement;
a bra cup size; and
a bra length size;

receiving, at the artificially-intelligent, sizing application, a selection of a body shape from a plurality of body shapes stored at a database;

approximating, at the artificially-intelligent, sizing application, a waist measurement and a low hip measurement based on the body measurement information, said waist measurement being a crease in the body when the body is bent to one side, said low hip measurement being a widest point on the body below the waist measurement;

processing, at the artificially-intelligent, sizing application, a differential between the waist measurement and the low hip measurement;

selecting, based on the differential and based on the selection of the body shape, at the artificially-intelligent, sizing application, one or more body shapes that correspond to the body, from the plurality of body shapes;

selecting, based on the received body measurement information, at the artificially-intelligent, sizing application, one or more body sizes that correspond to the body, from a plurality of body sizes stored at the database;

identifying, at the artificially-intelligent, sizing application, one or more combinations of the one or more body shapes and the one or more body sizes; and presenting, at a graphical user interface, via the artificially-intelligent, sizing application, the one or more combinations of the one or more body shapes and the one or more body sizes.

2. The one or more non-transitory computer-readable media storing computer-executable instructions of claim 1, wherein the body measurement information further comprises an age.

3. The one or more non-transitory computer-readable media storing computer-executable instructions of claim 1, wherein each of the one or more combinations is accompanied by a percentage of accuracy that the body corresponds to each of the one or more combinations, where a sum of the percentages of accuracy is 100%.

4. The one or more non-transitory computer-readable media storing computer-executable instructions of claim 1, further comprising receiving a selection, at the artificially-intelligent, sizing application of one of the one or more combinations of the one or more body shapes and the one or more body sizes.

5. The one or more non-transitory computer-readable media storing computer-readable executable instructions of claim 4, further comprising prepopulating the selection of the one or more combinations of the one or more body shapes and the one or more body sizes into a shape and size selection field when selecting one or more articles of clothing.

6. The one or more non-transitory computer-readable media storing computer-executable instructions of claim 4, further comprising recommending using the selection of the one or more combinations of the one or more body shapes and the one or more body sizes when selecting one or more articles of clothing.

7. The one or more non-transitory computer-readable media storing computer-executable instructions of claim 4, further comprising using the selection of the one or more combinations of the one or more body shapes and the one or more body sizes to facilitate a purchase of one or more articles of clothing.

8. The one or more non-transitory computer-readable media storing computer-executable instructions of claim 7, further comprising:

receiving, at the artificially-intelligent, sizing application, a return of the purchase of the one or more articles of clothing;

comparing, at the artificially-intelligent, sizing application, a set of measurements of the one or more articles of clothing to the received body measurement information;

identifying, at the artificially-intelligent, sizing application, one or more locations in the set of measurements in which the one or more articles of clothing was unsuitable; and importing, at the artificially-intelligent, sizing application, the one or more locations that were unsuitable to the database, said database powering the artificially-intelligent, sizing application, thereby increasing a knowledge base of the plurality of body sizes and the plurality of body shapes.

9. The one or more non-transitory computer-readable media storing computer-executable instructions of claim 7, further comprising:

receiving, at the artificially-intelligent, sizing application, an indication of contentment of the purchase of the one or more articles of clothing;

comparing, at the artificially-intelligent, sizing application, a set of measurements of the one or more articles of clothing to the received body measurement information;

identifying, at the artificially-intelligent, sizing application, one or more locations in the set of measurements in which the one or more articles of clothing was suitable; and importing, at the artificially-intelligent, sizing application, the one or more locations that were suitable to the database, said database powering the artificially-intelligent, sizing application, thereby increasing a knowledge base of the plurality of body sizes and the plurality of body shapes.

10. The one or more non-transitory computer-readable media storing computer-executable instructions of claim 1, wherein the one or more body shapes selected from the plurality of body shapes comprises a first body shape, the first body shape comprising:

the differential between the low hip measurement and the waist measurement up to and including 3.0 inches;

over a threshold of similarity between:

a bust measurement, said bust measurement being determined by the bra cup size and the bra length size;

the waist measurement; and the low hip measurement;

a greater concentration of body weight in a front central portion of the body; and a widest body part circumference being a waist, identified by the waist measurement.

11. The one or more non-transitory computer-readable media storing computer-executable instructions of claim 1, wherein the one or more body shapes selected from the plurality of body shapes comprises a second body shape, the second body shape comprising:

the differential between the low hip measurement and the waist measurement between about 3.1 inches to 8.0 inches;

over a threshold of similarity between:

a bust measurement, said bust measurement being determined by the bra cup size and the bra length size; and the low hip measurement;

evenly distributed body weight within a body torso;

a widest body part circumference being either a bust, identified by the bust measurement or hips, identified by the low hip measurement.

12. The one or more non-transitory computer-readable media storing computer-executable instructions of claim 1, wherein the one or more body shapes selected from the plurality of body shapes comprises a third body shape, the third body shape comprising:

the differential between the low hip measurement and the waist measurement greater than 8.0 inches;

the waist measurement smaller than the low hip measurement;

a bust measurement, said bust measurement being determined by the bra cup size and the bra length size, smaller than the low hip measurement;

a greater concentration of body weight in a body thighs portion and a body backside portion; and a widest body part circumference being hips, identified by the low hip measurement.

13. The one or more non-transitory computer-readable media storing computer-executable instructions of claim 12, wherein each of the one or more combinations is accompanied by a percentage of accuracy that the body corresponds to the combination, where a sum of the percentages of accuracy is 100%.

14. The one or more non-transitory computer-readable media storing computer-executable instructions of claim 1, further comprising:

receiving, at the artificially-intelligent, sizing application, the waist measurement and the low hip measurement; and reprocessing, at the artificially-intelligent, sizing application, in response to receiving the waist measurement and the low hip measurement, the differential between the waist measurement and the low hip measurement using the received waist measurement and the low hip measurement instead of the approximated waist measurement and the approximated low hip measurement;

re-identifying, at the artificially-intelligent, sizing application, the one or more body shapes based on the differential;

re-identifying, at the artificially-intelligent, sizing application, the one or more body sizes based on the received body measurement information;

re-identifying, at the artificially-intelligent, sizing application, the one or more combinations of the one or more body shapes and the one or more body sizes; and re-presenting, at the GUI, the one or more combinations of the one or more body shapes and the one or more body sizes.

15. An artificially-intelligent body size and body shape identification system, the system comprising:

a graphical user interface ("GUI") operating on a hardware processor coupled to a memory, the GUI operable to:

display:

a plurality of body shapes;

receive:

a height measurement relating to a body;

a weight measurement relating to the body;

a bra cup size relating to the body;

a bra length size relating to the body; and a selection of one of the body shapes included in the plurality of body shapes;

an artificially-intelligent, sizing application operating on the hardware processor coupled to the memory, said application operable to:

receive the height measurement, the weight measurement, the bra cup size, the bra length size and the selection of one of the body shapes;

select, based on the height measurement, the weight measurement, the bra cup size, the bra length size and the selection of one of the body shapes, one or more combinations of one or more body shapes and one or more body sizes that correspond to the body; and the GUI is operable to present one or more combinations of the one or more body shapes and the one or more body sizes;

wherein:

the GUI is further operable to:

receive a first body measurement, said first body measurement being a circumference of the body at a point on the body identified by a crease in a torso of a body when the body is bent to one side; and receive a second body measurement, said second body measurement being a circumference of the body at a second point on the body identified by a widest circumference on the body below the first body measurement;

the artificially-intelligent, sizing application further operable to:

receive the first body measurement and the second body measurement;

process a differential between the first body measurement and the second body measurement; and re-select, based on the differential, the one or more combinations of one or more body shapes and one or more body sizes that correspond to the body;

the GUI is further operable to:

re-present one or more combinations of the one or more body shapes and one or more body sizes that correspond to the body.

16. The artificially-intelligent body size and body shape identification system of claim 15, wherein:

the plurality of body shapes comprises a first body shape, a second body shape and a third body shape;

the first body shape comprises the differential between the first body measurement and the second body measurement between about −2 inches and 3.0 inches;

the second body shape comprises the differential between the first body measurement and the second body measurement between about 3.1 inches and 8.0 inches; and the third body shape comprises the differential between the first body measurement and the second body measurement greater than about 8.0 inches.

17. An artificially-intelligent body size and body shape identification system, the system comprising:

a graphical user interface ("GUI") operating on a hardware processor coupled to a memory, the GUI operable to:

display:

a plurality of body shapes;

receive:

a height measurement relating to a body;

a weight measurement relating to the body;

an age relating to the body;

a bra cup size relating to the body;

a bra length size relating to the body; and a selection of one of the body shapes included in the plurality of body shapes;

an artificially-intelligent, sizing application operating on the hardware processor coupled to the memory, said application operable to:

receive the height measurement, the weight measurement, the age, the bra cup size, the bra length size and the selection of one of the body shapes;

identify that the selection of the one of the body shapes included in the plurality of body shapes does not correspond to the height measurement, weight measurement, the age, the bra cup size and the bra length size; and select, based on the height measurement, the weight measurement, the age, the bra cup size, the bra length size and the selection of one of the body shapes, one or more applicable combinations of one or more body shapes and one or more body sizes that correspond to the body; and the GUI is operable to present one or more combinations of the one or more applicable combinations of body shapes and the one or more body sizes;

wherein:

the GUI is operable to:

receive a selection of one of the one or more applicable combinations of body shapes and body sizes; and use the selection of the one of the one or more applicable combinations of body shapes and body sizes to facilitate a purchase of one or more articles of clothing;

the artificially-intelligent, sizing application is operable to:

receive data relating to a return of the purchase of the one or more articles of clothing;

compare a set of measurements of the one or more articles of clothing to the height measurement, the weight measurement, the age, the bra cup size, the bra length size and the selection of one of the body shapes;

identify one or more locations in the set of measurements in which the one or more articles of clothing was unsuitable; and import the one or more locations that were unsuitable to a database powering the artificially-intelligent, sizing application, thereby increasing a knowledge base of the one or more body sizes and the one or more body shapes.

18. An artificially-intelligent body size and body shape identification system, the system comprising:

a graphical user interface ("GUI") operating on a hardware processor coupled to a memory, the GUI operable to:

display:

a plurality of body shapes;

receive:

a height measurement relating to a body;

a weight measurement relating to the body;

an age relating to the body;

a bra cup size relating to the body;

a bra length size relating to the body; and a selection of one of the body shapes included in the plurality of body shapes;

an artificially-intelligent, sizing application operating on the hardware processor coupled to the memory, said application operable to:

receive the height measurement, the weight measurement, the age, the bra cup size, the bra length size and the selection of one of the body shapes;

identify that the selection of the one of the body shapes included in the plurality of body shapes does not correspond to the height measurement, weight measurement, the age, the bra cup size and the bra length size; and select, based on the height measurement, the weight measurement, the age, the bra cup size, the bra length size and the selection of one of the body shapes, one or more applicable combinations of one or more body shapes and one or more body sizes that correspond to the body; and the GUI is operable to present one or more combinations of the one or more applicable combinations of body shapes and the one or more body sizes;

wherein:

the GUI is operable to:

receive a selection of one of the one or more applicable combinations of body shapes and body sizes; and use the selection to facilitate a purchase of one or more articles of clothing;

the artificially-intelligent, sizing application is operable to:

receive an indication of contentment of the purchase of the one or more articles of clothing;

compare a set of measurements of the one or more articles of clothing to the received height measurement, the weight measurement, the age, the bra cup size, the bra length size and the selection of one of the body shapes;

identify one or more locations in the set of measurements in which the one or more articles of clothing was suitable; and import the one or more locations that were suitable to a database, said database powering the artificially-intelligent, sizing application, thereby increasing a knowledge base of the one or more body sizes and the one or more body shapes.

* * * * *